US005703615A

United States Patent [19]

Usami

[11] Patent Number: 5,703,615

[45] Date of Patent: Dec. 30, 1997

[54] METHOD FOR DRIVING MATRIX TYPE FLAT PANEL DISPLAY DEVICE

[75] Inventor: Yoshihisa Usami, Shizuoka, Japan

[73] Assignee: Fuji Photo Film Co., Ltd., Kanagawa, Japan

[21] Appl. No.: 457,305

[22] Filed: Jun. 1, 1995

Related U.S. Application Data

[63] Continuation of Ser. No. 15,864, Feb. 10, 1993, abandoned.

[30] Foreign Application Priority Data

| | | | |
|---|---|---|---|
| Feb. 10, 1992 | [JP] | Japan | 4-057565 |
| Feb. 10, 1992 | [JP] | Japan | 4-057566 |
| Dec. 14, 1992 | [JP] | Japan | 4-352813 |

[51] Int. Cl.[6] ..... B09G 3/36

[52] U.S. Cl. ..... 345/97; 345/94

[58] Field of Search ..... 345/78, 94, 95, 345/97, 208, 210, 96, 87, 101; 349/42, 43, 34, 36, 41, 46

[56] References Cited

U.S. PATENT DOCUMENTS

| | | | |
|---|---|---|---|
| 5,111,317 | 5/1992 | Coulson | 340/805 |
| 5,128,663 | 7/1992 | Coulson | 340/805 |
| 5,267,065 | 11/1993 | Taniguchi et al. | 345/97 |

*Primary Examiner*—Chanh Nguyen

*Attorney, Agent, or Firm*—Sughrue, Mion, Zinn, Macpeak & Seas, PLLC

[57] ABSTRACT

There is provided a matrix-addressed driving method by which the image quality of a matrix type flat panel display device having bistability can be improved. Immediately after an application of an effective pulse of a selection signal, a counter-assist signal which has a polarity inverse to the polarity of the effective pulse of a selection signal for inverting the dark or bright state is added to the scanning signal. In lieu of this counter-assist signal or in addition to the counter-assist signal, an aid-assist signal having a polarity same as the polarity of the effective pulse of the selection signal may also be added at least one time before or after the application of the effective pulse.

14 Claims, 41 Drawing Sheets

FIG. 5A Sequence Examples in Two-Pulse Method
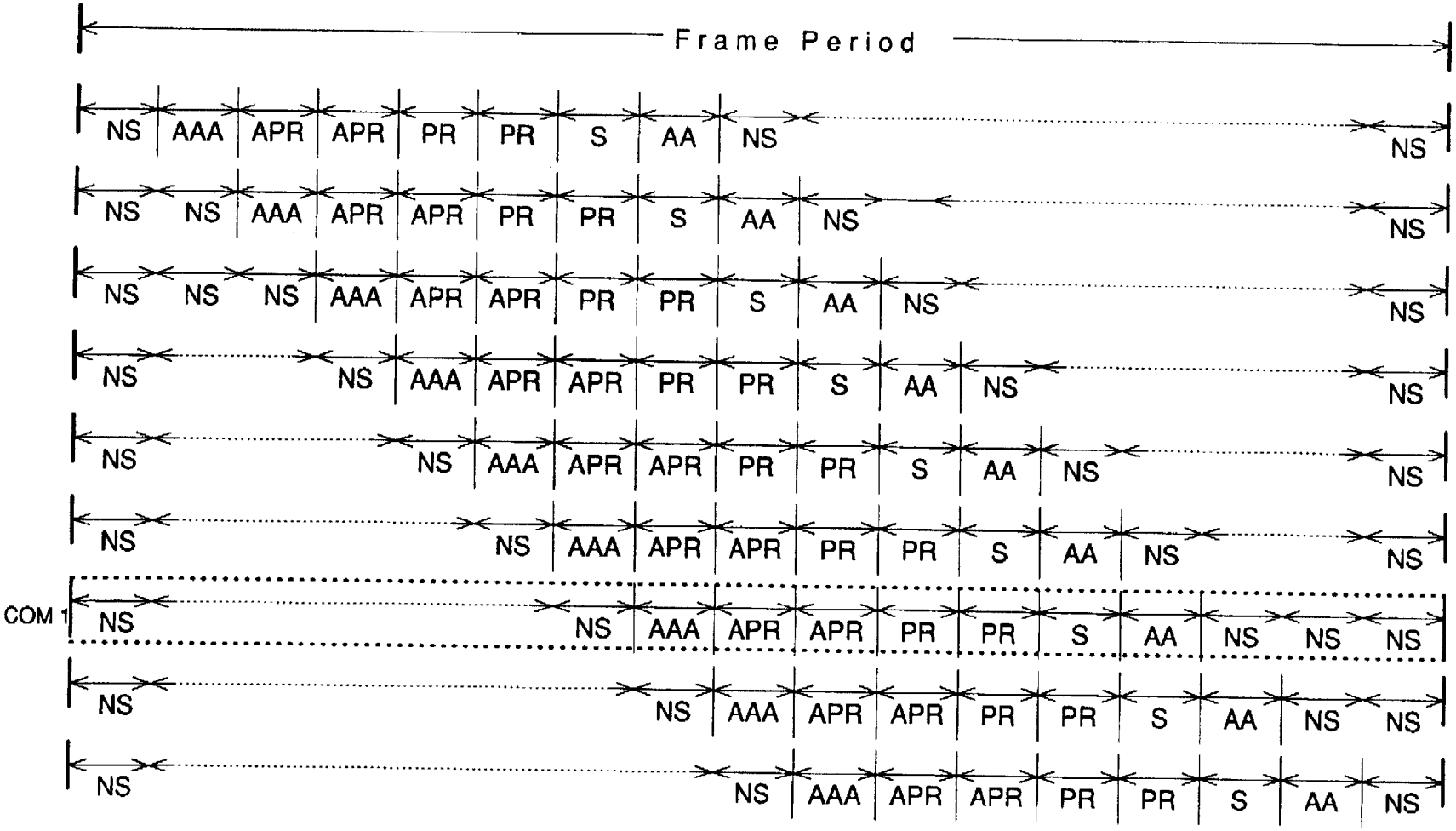

Example wherein a flash negative electric potential is applied

Drive Margin Index : 3/2=1.5

Three-Pulse Method
(Counter-Assisted)

Drive Margin Index : 3/1=3

Sequence Examples in Three-Pulse Method

Sequence Examples in Three-Pulse Counter-Assist Method

Drive Margin Index : 4/3=1.33

ON during the selection time, kept ON subsequently

OFF during the selection time, then turned to ON

ON during the selection time, then turned to OFF

OFF during the selection time, kept OFF subsequently

Drive Margin Index :4/2=2

Sequence Examples in Four-Pulse Method

Sequence Examples in Four-Pulse Counter-Assisted Method

FIG.19

| | Combination | Pulse Area | | |
|---|---|---|---|---|
| | | Bright → Dark | Dark → Bright | |
| | Dγ0 Bγ0 | 5 | 7 | |
| ※ | Dγ0 Bγ1 | 5 | 6 | γγ |
| | Dγ1 Bγ0 | 4 | 7 | |
| | Dγ1 Bγ1 | 4 | 6 | |
| | Dγ0 Bσ0 | 5 | 7 | |
| ※ | Dγ0 Bσ1 | 5 | 6 | γσ |
| | Dγ1 Bσ0 | 4 | 7 | |
| | Dγ1 Bσ1 | 4 | 6 | |
| | Dσ0 Bγ0 | 5 | 7 | |
| ※ | Dσ0 Bγ1 | 5 | 6 | σγ |
| | Dσ1 Bγ0 | 4 | 7 | |
| | Dσ1 Bγ1 | 4 | 6 | |
| | Dσ0 Bσ0 | 5 | 7 | |
| ※ | Dσ0 Bσ1 | 5 | 6 | σσ |
| | Dσ1 Bσ0 | 4 | 7 | |
| | Dσ1 Bσ1 | 4 | 6 | |

Pre-Reset Two-Pulse Method
(1/4 Bias Applied)

(Aid -Assist not Applied)

ON during the selection time,
kept ON subsequently

ON during the selection time,
then turned to OFF

OFF during the selection time,
then turned to ON

OFF during the selection time,
kept OFF subsequently

Drive Margin Index : 4/3=1.33

Pre-Reset Two-Pulse Method
(1/4 Bias Applied)
(Aid-Assist Applied)

ON during the selection time,
kept ON subsequently

ON during the selection time,
then turned to OFF

OFF during the selection time,
then turned to ON

OFF during the selection time,
kept OFF subsequently

Drive Margin Index : 8/7=1.14

1/2 Bias
Aid-Assist Pre-Reset
Two-Pulse Method

Pre-Reset Two-Pulse Method
(1/2 Bias Applied)
(Aid -Assist not Applied)

ON during the selection time, kept ON subsequently

ON during the selection time, then turned to OFF

OFF during the selection time, then turned to ON

OFF during the selection time, kept OFF subsequently

Drive Margin Index : 4/2=2

1/2 Bias Aid-Assist Pre-Reset Two-Pulse Method
(Counter-Assist Added)

Wave Form Examples of Aid-Assist Signals

Paired Two for Every Alternate 1 $\tau$

Four-Pulse Method

ON during the selection time, kept ON subsequently

OFF during the selection time, then turned to ON

ON during the selection time, then turned to OFF

OFF during the selection time, kept OFF subsequently

Four-Pulse Method (Assisted)

ON during the selection time, kept ON subsequently

OFF during the selection time, then turned to ON

ON during the selection time, then turned to OFF

OFF during the selection time, kept OFF subsequently

Prior Art (Pre-Reset Two-Pulse Method)

METHOD FOR DRIVING MATRIX TYPE FLAT PANEL DISPLAY DEVICE

This is a Continuation of application Ser. No. 08/015,864, filed Feb. 10, 1993 now abandoned.

BACKGROUND OF THE INVENTION

1. Field of the Invention

The present invention relates to a matrix-addressed driving method adapted for driving a matrix type flat panel display device having a bistable performance characteristic.

2. Prior Art

A matrix type flat panel display device has been known, wherein a ferroelectric liquid crystal, or the like, having fast switching characteristic and bistability (memory property) is used. In the device of this type, all picture elements along a scanning electrode are forcibly reset to the dark state (or bright state) by applying a reset signal through the scanning electrode during a reset period (or reset time); and during a writing period (or writing time), by applying a selection signal through the scanning electrode and by applying a signal of bright state (or dark state) along a signal electrode (display electrode) to set a particular picture element at the crossing point of the selection signal and the signal electrode to the bright state (or dark state).

Meanwhile, such liquid crystals include the one having a performance characteristic where each picture element is turned to the bright state or dark state depending on the product of the voltage and the time (hereinafter, this product will be referred to as the effective value) applied to a picture element. It is desired that the difference or ratio between the minimum effective value of the signal needed for writing to the bright state (or dark state) and the maximum effective value which shall not be exceeded for keeping a particular picture element, which has been reset to a dark state, at the dark state, is as high as possible.

Such a difference or ratio between the effective values exerts a great influence upon the drive margin. Although the drive margin is changed not only depending on the difference or ratio of the effective values but also depending on the signal delay due to the property of the liquid crystal per se or due to the electric resistance, the drive margin can be broadened by increasing the difference or ratio of the effective values thereby to improve the quality of the image on the display face. Thus, the difference or ratio of the effective values will be referred to as the drive margin index.

Generally in the display device of this type, the quality of the image is affected by the voltage drop due to the electric resistance within the electrodes, the change in performance characteristic of the liquid crystal due to temperature change, the scattering of the performance characteristic of the product liquid crystal display panel, the change in frame frequency depending on the displayed object, or like various display conditions. However, the effects due to the changes in these display conditions can be suppressed by having a large drive margin index.

FIG. 32 is a diagram showing the wave forms of the drive signals synthesized by the combinations of the scanning signals and the display signals in the prior art pre-reset 1/4 bias two-pulse driving method; FIG. 33 is a chart showing a one frame scanning signal sequence applied through a certain scanning line; FIG. 34 is a diagram showing the difference between the drive signals depending on the combination of the selection signal and the non-selection signal; and FIG. 35 is a representation showing the change in contrast (B/D) (Brightness/Darkness) in terms of the pulse width.

In this two-pulse driving method, a pre-reset signal PR is input immediately before input of a selection signal to a scanning electrode so that a negative potential is forcibly applied on the picture elements to reset them to the dark state irrespective of whether the display signal is ON or OFF. Meantime, the scanning signal is a signal which has a pulse width of $2\tau$ and is applied on the scanning electrodes, and the display signal is a signal which has a pulse width of $2\tau$ and is applied on the display electrodes (signal electrodes). As a result, as a display electrode facing a particular picture element is input with the ON display signal when the pre-reset signal PR is input on the scanning electrodes, the particular picture element is applied with the signal X of FIG. 32 so that the picture element is forcibly reset to the dark state. On the other hand, as the OFF display signal is input on the display electrodes facing the other picture elements, the other picture elements are applied with the signal Y of FIG. 32.

Thus, as shown in FIG. 33, the particular scanning electrode is applied with a scanning signal including a selection signal S at a predetermined time corresponding thereto. Meanwhile, prior to the application of one or plural pre-reset signals PR, one or plural anti-pre-reset signals APR each having a polarity inverse to the polarity of each of these pre-reset signals PR are interposed so that the direct current component of the pre-reset signal PR is compensated by the anti-pre-reset signal APR.

Positive and negative pulse voltages are applied to each picture element, as aforementioned, with the aim to compensating the direct current component thereby preventing deterioration of the liquid crystal. Accordingly, such a driving mode will be referred to as the alternating current driving. Two of each of these APR and PR are successively interposed as shown in FIG. 33 for ensuring reliable resetting operation. When each of the scanning signal and the display signal has a pulse width of $2\tau$ as described above (FIG. 32), the pre-reset signal PR must have a width of not less than $2\tau$, and it is particularly desirous that it has a width of $4\tau$.

Assuming now that a selection signal S is input through the scanning electrode of a particular picture element and concurrently the ON signal is input through the display electrode of the same picture element, this picture element is applied with a signal B (Brightness) of FIG. 32 and the picture element is written to the bright state by a pulse (which will be referred to as the effective pulse) having a hatched area of +4 (effective value), the pulse being the final component of B. Likewise, each of the picture elements facing to the display electrodes through which the OFF signals are fed at that time is applied with a signal D (Darkness) to be kept at the dark state which has been written by resetting since the display of the picture element cannot be changed to the bright state by the final pulse having a hatched area of +2 (effective value).

Similarly, a picture element, which faces a scanning electrode fed with a non-selection signal NS and a display electrode fed with the ON signal, is applied with a pulse denoted by "1" as shown in FIG. 32; whereas each of the picture elements fed with the OFF signals is applied with a pulse denoted by "0" which has a polarity inverse to the polarity of the pulse "1"; and thus the displayed states of these picture elements are not changed.

FIG. 34 shows four possible combinations of pulses "1" or "0", which are to be fed after a certain picture element has been written to bright or dark by the pulse "B" or "D". In the Figure, the combination of "B" and "0" is denoted by "B0".

Since the liquid crystal used in this embodiment is written to bright or dark not by the potential of the drive pulse but by the effective value, i.e. the product of the voltage and the time of the pulse, the areas of the pulses of respective cases will now be compared. In case of "B0" the area is 5 to be written to bright, and in case of "B1" the area is 4 to be written to bright. On the contrary, in cases of "D0", "D1", the areas are, respectively, 3 and 2 to be necessarily kept at dark.

Writing to change the dark state to the bright state will now be discussed. That is the case where the drive pulse is linked from "D0" or "D1" to "B0" or "B1". When "D0→B0" is indicated by "00", "D0→B1" by "01", "D1→B0" by "10" and "D1→B1" by "11", the changes in brightness ratio (contrast) B/D between the bright and dark states relative to the pulse width are as shown in FIG. 35.

The experiment shown in FIG. 35 was conducted under the conditions as shown in the following Table 1, and the components and weight ratios thereof of the liquid crystal composition used therein are shown in Table 2.

TABLE 1

| Conditions for the Experiment of FIG. 35 | |
|---|---|
| Substrate: | Glass Plate (Thickness: 1.1 mm) |
| Electrode: | ITO (Indium Tin Oxide) The pattern was formed by etching. |
| Insulation Membrane: | $SiO_2$, Vapor deposition using an electron beam, Thickness: 100 nm |
| Oriented Membrane: | LQ 1800 (produced by HITACHI KASEI) |
| Rubbing: | Parallel rubbing using a napped Nylon cloth at 1400 rpm, 20 sec × 3 times |
| Assembly: | Cell Gap = 2 μm ($SiO_2$ small beads (produced by SHOKUBAI KASEI K.K.) was used as the gap-forming agent.) |
| Injection: | 100°, 30 minutes |
| Liquid Crystal: | Liquid crystal composition Ashown in Table 2 was used. |
| Method for Measurement: | Liquid crystal display elements were applied with respective driving wave forms at 35°, ± 42V, 120 duties Using a microscope (Nikon OPTIPHOTO 2-POL, Object Lens: M Plan 10) and a photo-diode, the quantity of the transmitting light through the bright frame and the quantity of the transmitting light through the dark frame were measured to find the Brightness (B) and the Darkness (D). B/D was determined by gradually increasing the pulse width. |

TABLE 2

Components of the Liquid Crystal Composition A

| Component | Weight Ratio (%) |
|---|---|
| 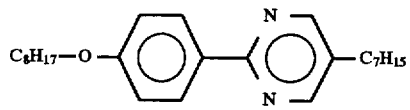 | 12.21 |
| 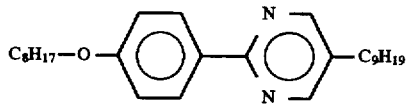 | 12.21 |
| 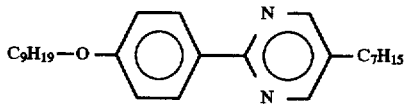 | 12.21 |
| 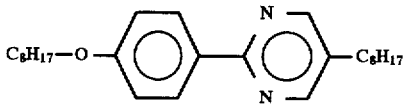 | 24.43 |
| 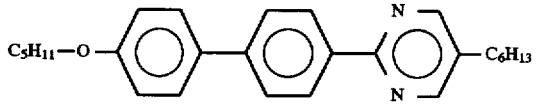 | 8.54 |
| 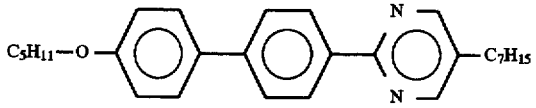 | 8.54 |

TABLE 2-continued

| Components of the Liquid Crystal Composition A | |
|---|---|
| Component | Weight Ratio (%) |
| 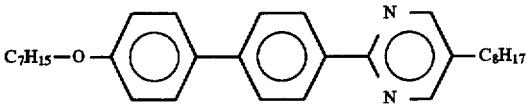 | 8.54 |
| 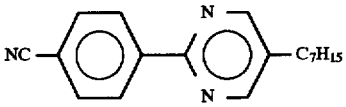 | 1.5 |
| 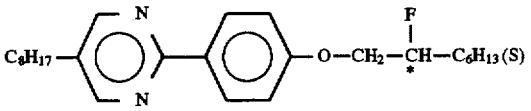 | 9.85 |
| 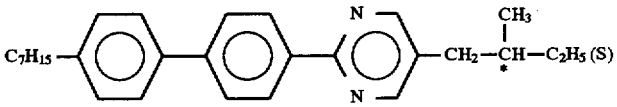 | 1.97 |

It should be understood from FIG. 35 that the contrast B/D takes the minimum value in the case of "01" (-Δ-), namely the case where the change from the dark to bright state is achieved by varying the pulse area from 3 to 4, and in addition the pulse width shall be set to a longer time of 20 to 30 μsec. Apparently, in the case of "01", the drive margin index becomes minimum (4/3) to bring the drive condition to the most severe condition. Under such condition, the prior art two-pulse method has a problem of deterioration of the image quality, since the contrast is low and the pulse width is large, which hinders speed-up of the switching speed accompanied with the tendency of occurrence of flicker.

On the other hand, in the prior art of this type, it is possible to increase the switching speed by increasing the driving voltage. However, in order to increase the driving voltage, the switching element of the driver circuit must be one which sustains a high electric voltage. It leads to a problem in that an IC which sustains a high electric voltage must be used to allow raising of the driving voltage since the IC includes a very large number of semiconductor switching elements which are used in the driver circuit. The electric power for the circuit is increased as the driving voltage is raised, with an attendant problem of increase in exothermic heat.

On the other hand, since the switching speed is lowered as the driving voltage is lowered, it becomes necessary to broaden the pulse widths of the drive signals in order to ensure reliable switching operation. However, in such a case, the time needed for writing one frame (frame period or frame time) becomes longer which induce flickering or flicker of the image. As a result, there arises a problem of deterioration of the image quality.

SUMMARY OF THE INVENTION

The present invention has been accomplished in view of the circumstances as aforementioned, and a first object of the invention is to provide a method for driving a matrix type flat panel display device in which the drive margin index can take a larger value to improve the image quality.

A second object of the invention is to provide a method for driving a matrix type flat panel display device in which the driving voltage can be lowered without the need of improvement in voltage-proof property of the switching elements used in the driver circuit to enable a higher speed switching and to improve the image quality.

According to the present invention, the first object thereof is achieved by the provision of an improvement in the method for driving a matrix type flat panel display device wherein bistable picture elements are arranged at the points where scanning electrodes and signal electrodes are crossing with each other, each reset period for resetting all picture elements along each row of scanning electrodes to any of the dark or bright state being set by the application of a reset signal along said each row of scanning electrodes, and each writing period for writing and storing the picture elements along each row of said scanning electrodes under the bright or dark state being set by a selection signal;

the improvement which comprises a method for driving a matrix type flat panel display device characterized in that said scanning signal includes an additional counter-assist signal having a polarity inverse to the polarity of the effective pulse of a selection signal for inverting the dark or bright reset state, said additional counter-assist signal being applied immediately after the application of said effective pulse.

Meanwhile, the wave form, electric voltage and width of the counter-assist signal should be determined in consideration of the effect of the effective value, i.e. the product of the applied voltage and the time duration of the counter-assist signal, of the counter-assist signal additionally applied to the picture element inducing the increase of drive margin, and it is desirable to ensure as large a drive margin index as possible. Particularly, the width or time duration of the counter-assist signal is set to the width same as that of the selection signal, or a multiple or a fraction of an integer of the width of the selection signal, in view of the fact that a clock for setting an alternating current signal pulse width is utilized.

The second object is achieved by the provision of an improvement in the method for driving a matrix type flat panel display device wherein bistable picture elements are arranged at the points where scanning electrodes and signal electrodes are crossing with each other, each reset period for resetting all picture elements along each row of scanning electrodes to any of the dark or bright state being set by the application of a reset signal along said each row of scanning electrodes, and each writing period for writing and storing the picture elements at the crossing points of a row of said scanning electrodes applied with a selection signal and a row of said signal electrodes applied with a writing signal under the bright or dark state being set by a selection signal;

the improvement which comprises a method for driving a matrix type flat panel display device characterized in that said scanning signal includes an additional aid-assist signal having a polarity same as the polarity of the effective pulse of the selection signal for inverting the dark or bright reset state, said additional aid-assist signal being applied at least one time immediately before or immediately after the application of said effective pulse.

Meantime, as to the location at which the aid-assist signal is added, it may be immediately after, immediately before or either at immediately before and after the application of the effective pulse of the selection signal. The electric voltage and width of this aid-assist signal should be determined in consideration of the effective value, i.e. the product of the applied electric voltage and the time duration, when the particular picture element is a kind of the picture element to which writing is effected by the effective value additionally applied thereto; and it is desirable to ensure as large a drive margin index as possible by the addition of the aid-assist signal.

BRIEF DESCRIPTION OF THE DRAWINGS

The above and other objects and advantages of the present invention will become apparent from the following detailed descriptions of the preferred embodiments of the invention while referring to the appended drawings, in which:

FIG. 5A is a chart showing the sequence examples in the first embodiment (two-pulse method);

FIG. 19 is a diagram showing the changes in pulse area when a certain picture element is rewritten from the dark state to the bright state by changing the combinations of respective driving wave forms of FIG. 18 in the fifth embodiment;

DESCRIPTION OF THE PREFERRED EMBODIMENTS

Figure 1:
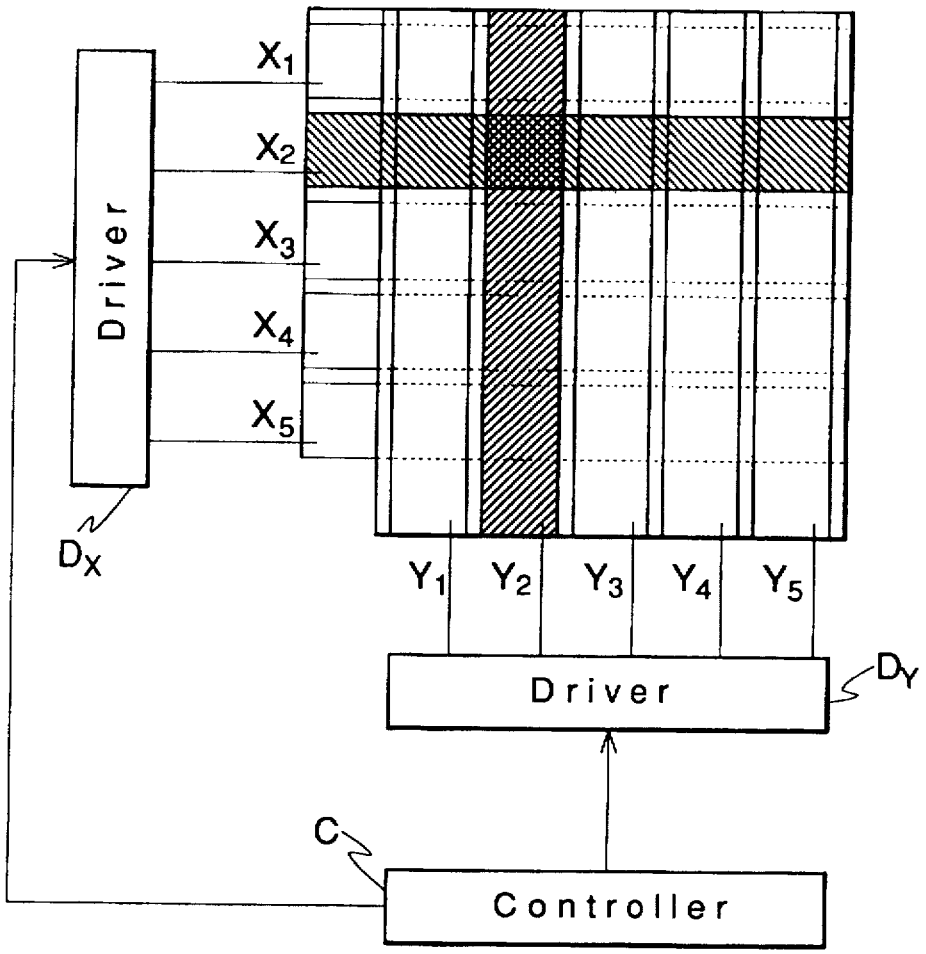
FIG. 1 is a conceptual illustration showing the arrangement of the electrodes on the liquid crystal display panel to which the present invention is applied.
Figure 2:
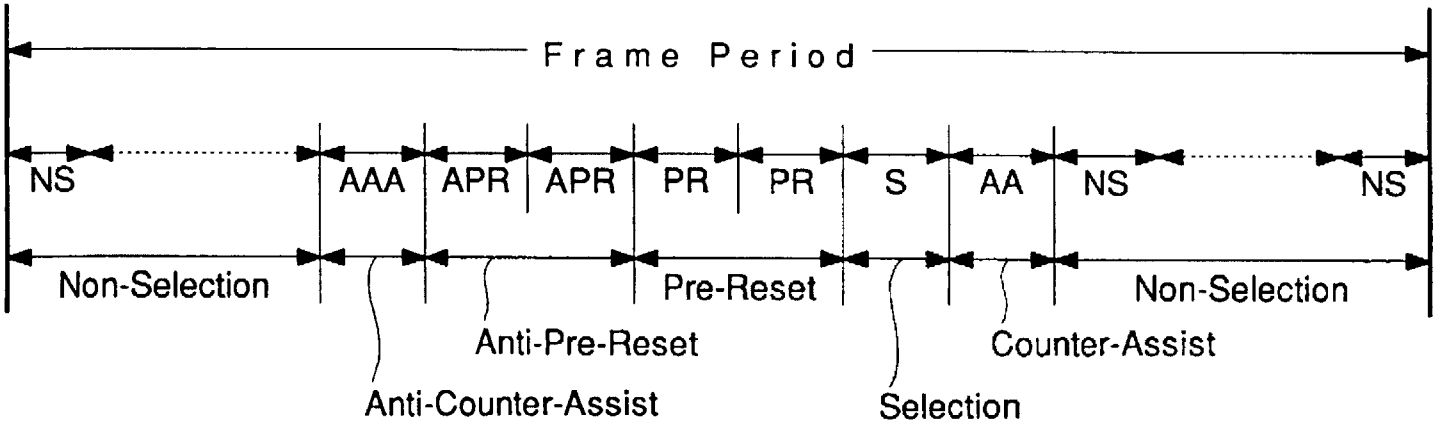
FIG. 2 is a chart showing a sequence example of the scanning signals in a first embodiment of the invention which is adapted to a 1/4 bias two-pulse driving method. In the Figure, S denotes a selection signal, NS denotes a non-selection signal, AA denotes a counter-assist signal, PR denotes a pre-reset signal, APR denotes an anti-pre-reset signal, and AAA denotes an anti-counter-assist signal (these abridged denotations being used throughout the specification and drawings)
Figure 3:
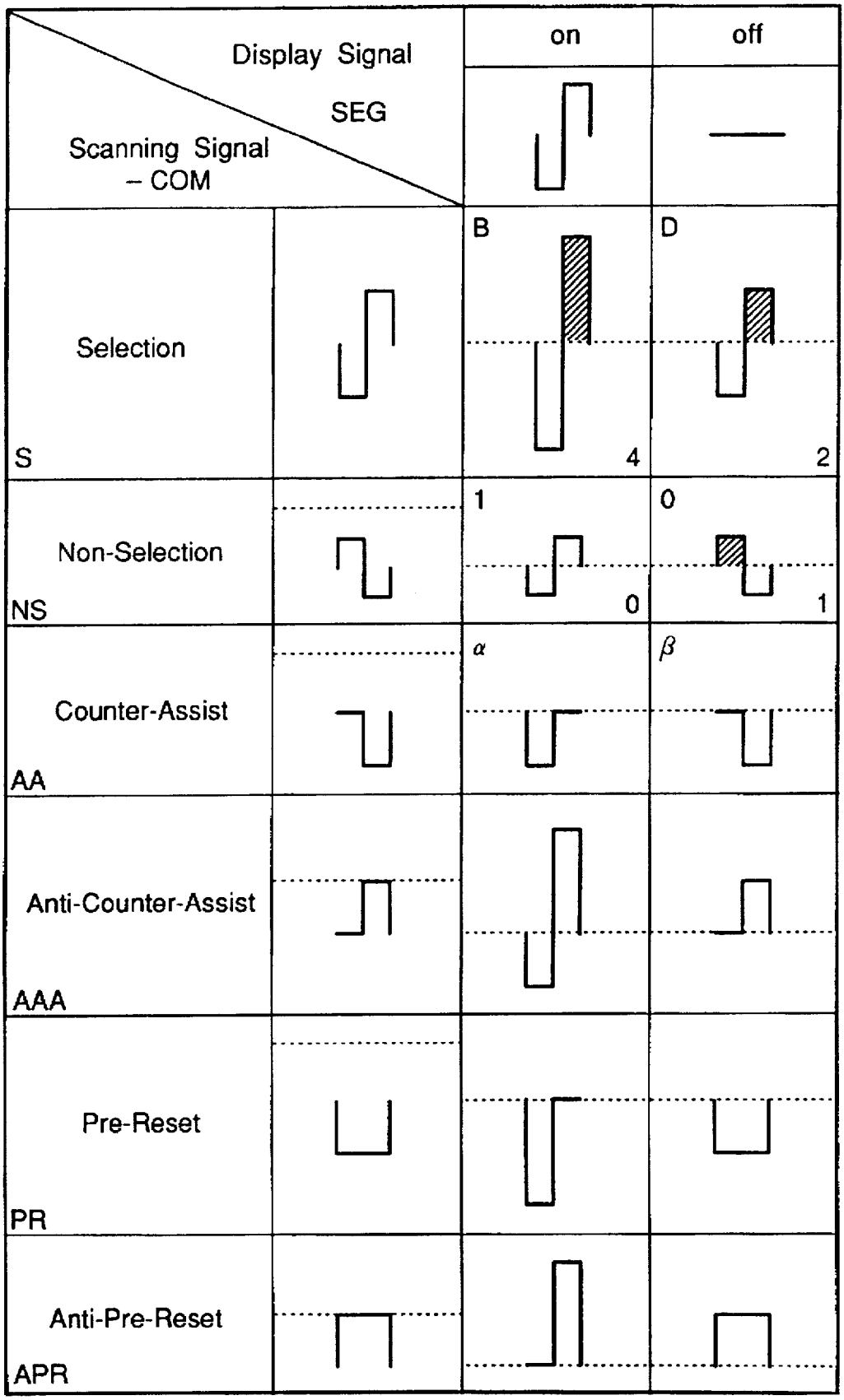
FIG. 3 is a diagram showing the wave forms of the drive signals applied on the picture elements in the first embodiment.
Figure 4:
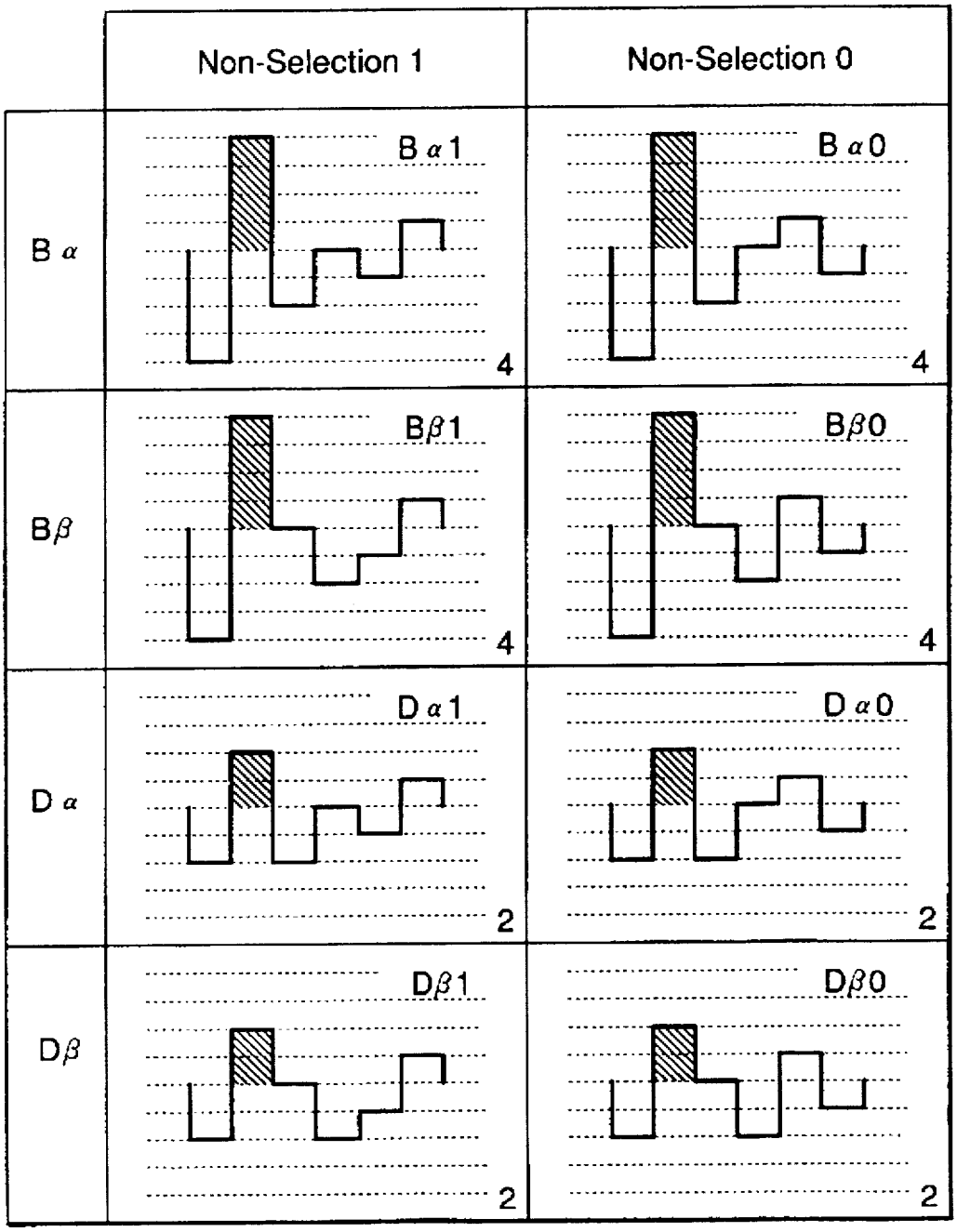
FIG. 4 is a diagram showing the difference in wave form of the drive signals which differ responsive to the combinations of respective signals in the first embodiment.
Figure 5B:
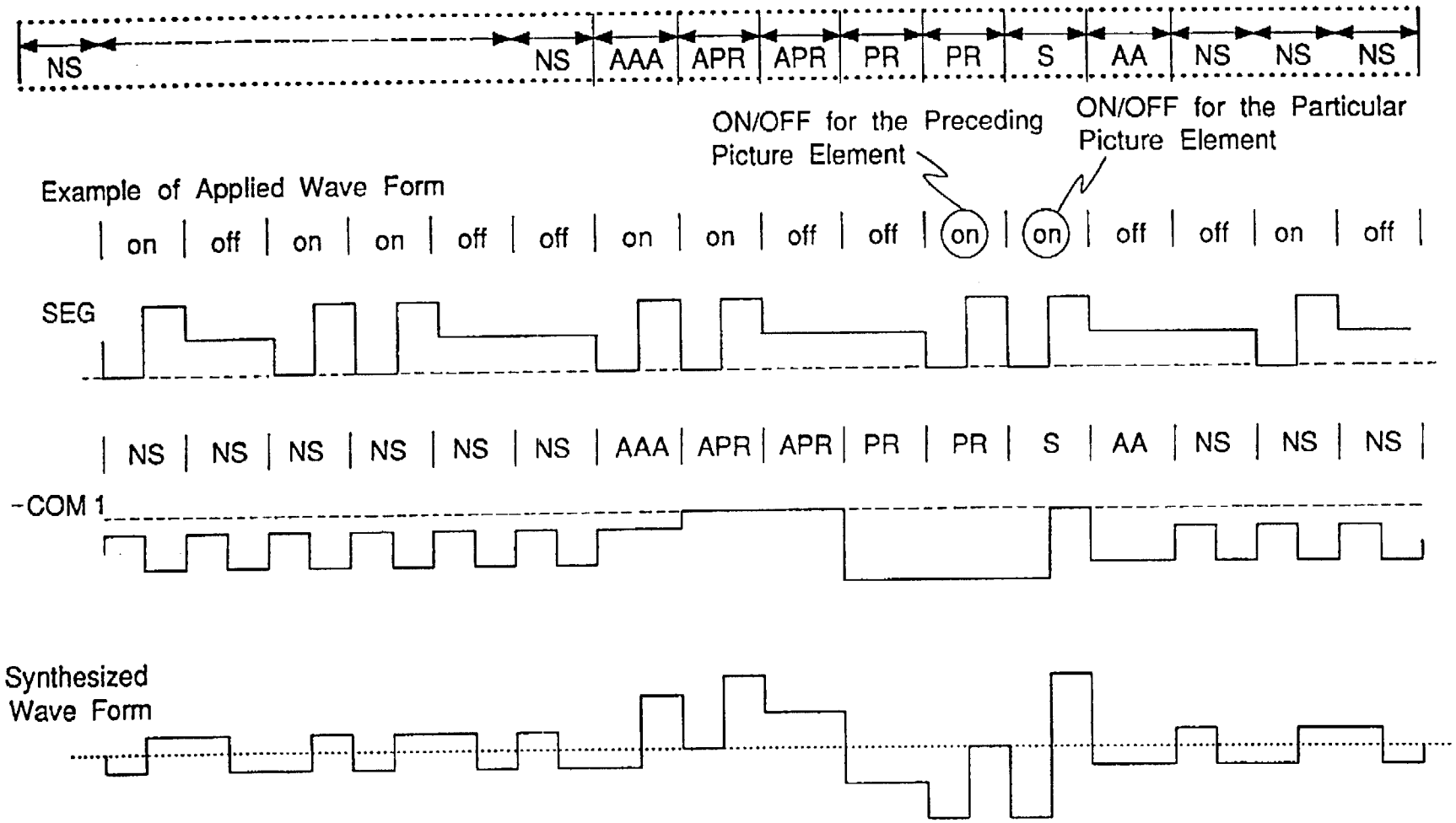
FIG. 5B shows a synthesized wave form obtained by combining the scanning signal COM 1, which is one sequence example shown in FIG. 5A, with a display signal (SEG)

FIG. 1 is a conceptual plan view showing the arrangement of the scanning electrodes of a flat panel display device to which the present invention is applied; FIG. 2 is a chart showing a sequence example of the scanning signals of an embodiment in which the present invention is applied to the 1/4 bias two-pulse driving method; FIG. 3 is a diagram showing the wave forms of the drive signals applied on the picture elements; FIG. 4 is a diagram showing the difference in wave form of the drive signals which differ responsive to the combinations of respective signals; FIGS. 5 show the sequence examples in this embodiment.

In FIG. 1, $X_1$ to $X_5$ designate scanning electrodes, $Y_1$ to $Y_5$ designate display electrodes (signal electrodes); and it is a matter of course that a very large number of electrodes are provided in an actual embodiment although only five for either electrodes have been shown for the simplicity of illustration. These electrodes are driven by respective drivers $D_X$, $D_y$. Image signals are input to a controller C, and respective drivers $D_X$, $D_y$ supply predetermined signals to respective electrodes $X_1$ to $X_5$ and $Y_1$ to $Y_5$ in response to the outputs from the controller C.

Figure 32:
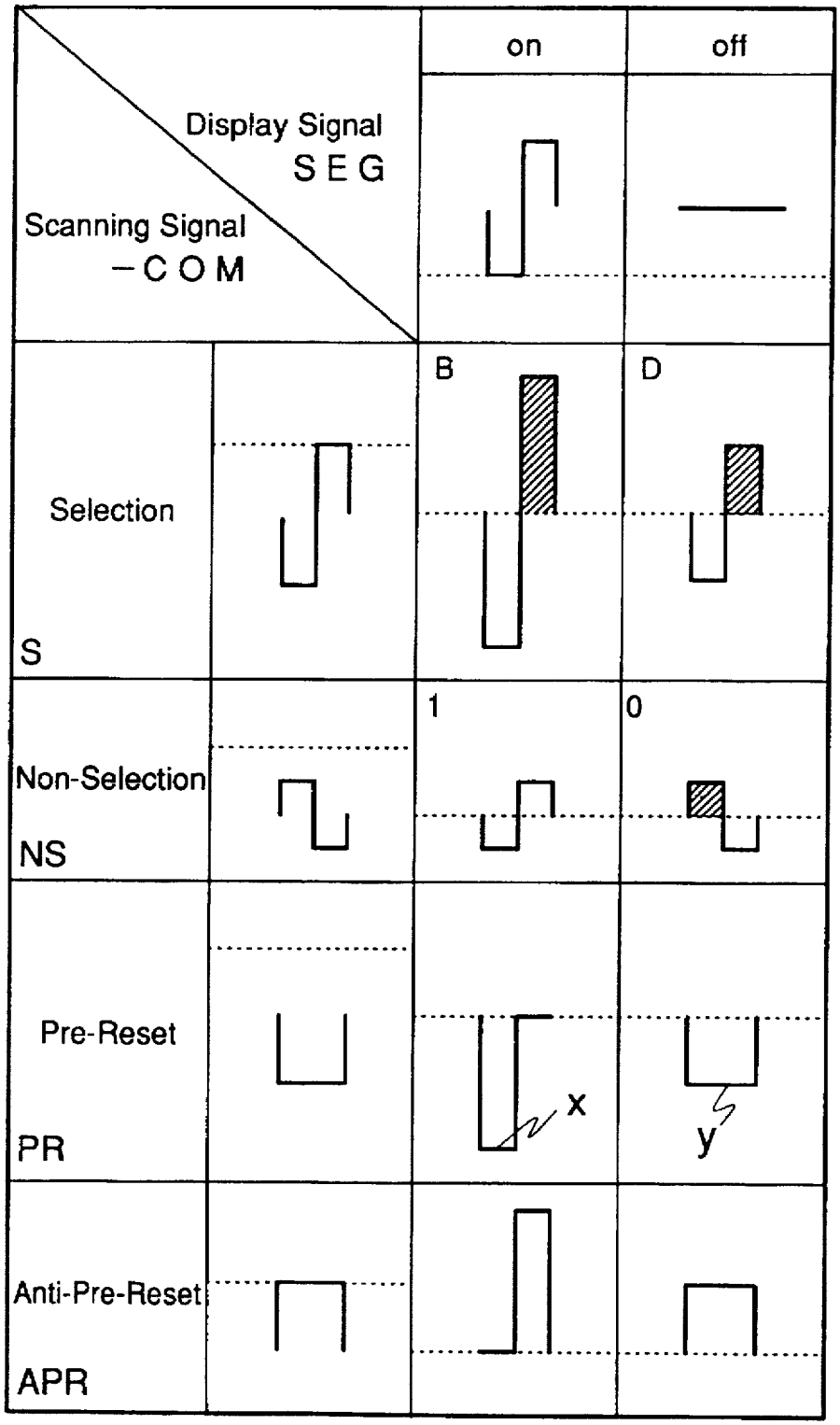
FIG. 32 Prior Art
FIG. 32 is a diagram showing the wave forms of the drive signals synthesized by the combinations of the scanning signals and the display signals in the prior art two-pulse driving method.
Figure 33:
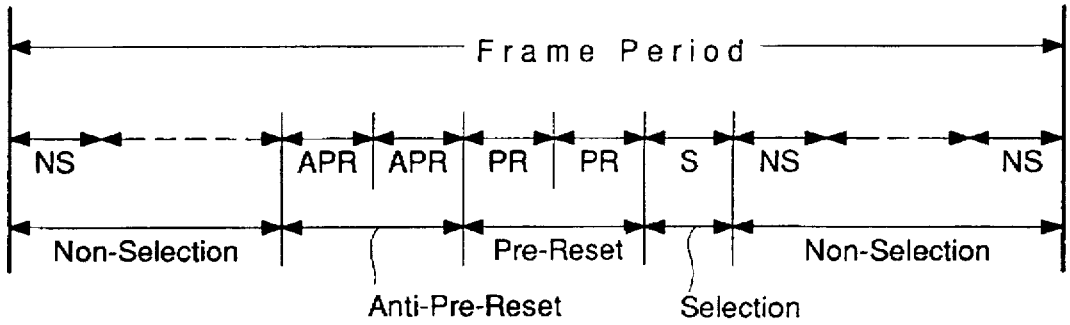
FIG.33 Prior Art
FIG. 33 is a chart showing the scanning signal sequence in the prior art of FIG. 32.

The scanning signal comprises, as shown in FIG. 2, a selection signal S, two pre-reset signals PR and two anti-pre-reset signals APR interposed immediately before the selection signals, a counter-assist signal AA added immediately after the selection signal S, an anti-counter-assist signal AAA added before the anti-pre-reset signal APR, and multiple non-selection signals NS. The pre-reset signal PR and the anti-pre-reset signal APR have the wave forms same as those described in the preceding description of FIG. 32, and the description thereof will not be repeated.

The anti-counter-assist signal AAA has a polarity inverse to the polarity of the counter-assist signal AA and is added to compensate a direct current component which is generated by the addition of the counter-assist signal AA. The anti-counter-assist signal AAA Shall be interposed before the application of the selection signal S and the pre-reset signal PR, and it is particularly suitable to apply it before, intermediately of or after the application of the anti-pre-reset signal APR.

The counter-assist signal AA has, as shown in FIG. 3, a time width $2\tau$ which is the same as of the selection signal S, and during the former time period $\tau$ the electric voltage is changed to $-2$ and during the latter time period $\tau$ the electric potential is changed to $-4$. The wave form of the drive signal when the display signal is ON at the timing of output of this counter-assist signal AA will be represented by "$\alpha$", and the wave form of the drive signal when the display signal is OFF at the same timing will be represented by "$\beta$". Meanwhile, the pulse area is shown in FIG. 3 at the right position below each of the drive signal wave forms.

FIG. 4 shows the combinations of these signals. For instance, when an counter-assist signal $\alpha$ and a signal "1" as the non-selection signal NS are combined to be applied after the application of the signal "B" for rewriting to brightness, the combined drive signals applied on the picture element is "B$\alpha$1" having the wave form as shown in FIG. 4. In this case, the counter-assist signal $\alpha$ having an electric voltage of $-2$ is applied after the application of the effective pulse, that is the pulse contributing for rewriting to brightness, having an electric voltage of 4, so that the pulse area (hatched portion) contributing for rewriting to brightness becomes 4. Similarly, the pulse areas contributing for rewriting for respective combinations are shown at the right position below respective wave forms.

Figure 34:
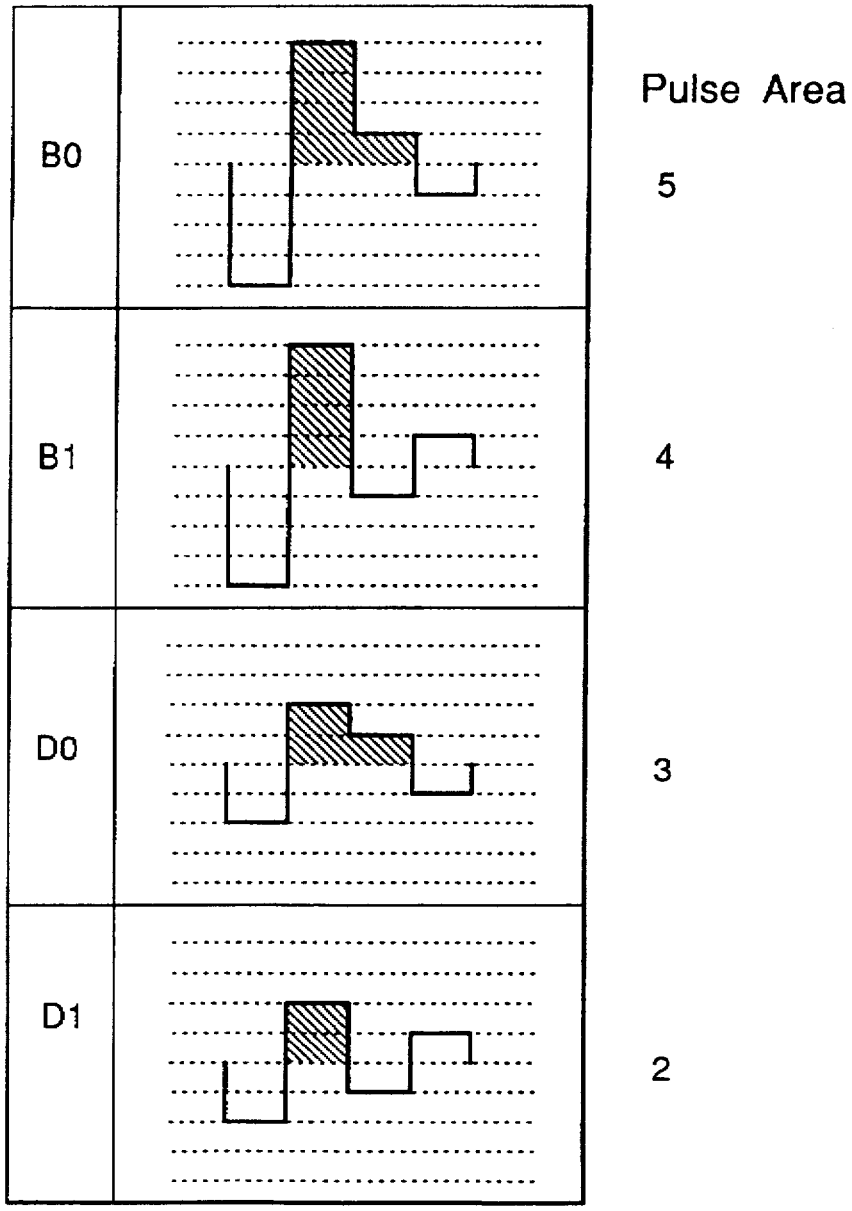
FIG.34 Prior Art
FIG. 34 is a diagram showing the drive signals obtained by the combinations of the selection signals and the non-selection signals in the prior art of FIG. 32.

As will be apparent from FIG. 4, the pulse area for rewriting from the dark state to brightness takes the value 4 for every case, and the pulse area for keeping the dark state is 2 for every cases. Thus, the ratio between the pulse area of 4 for rewriting to brightness and the pulse area of 2 for keeping the dark state is 4/2=2, which is considerably increased as compared to the pulse area ratio of 4/3 in the prior art method shown in FIG. 34. It should be understood that the drive margin index can be set to a larger value to improve the image quality accordingly.

Figure 6:
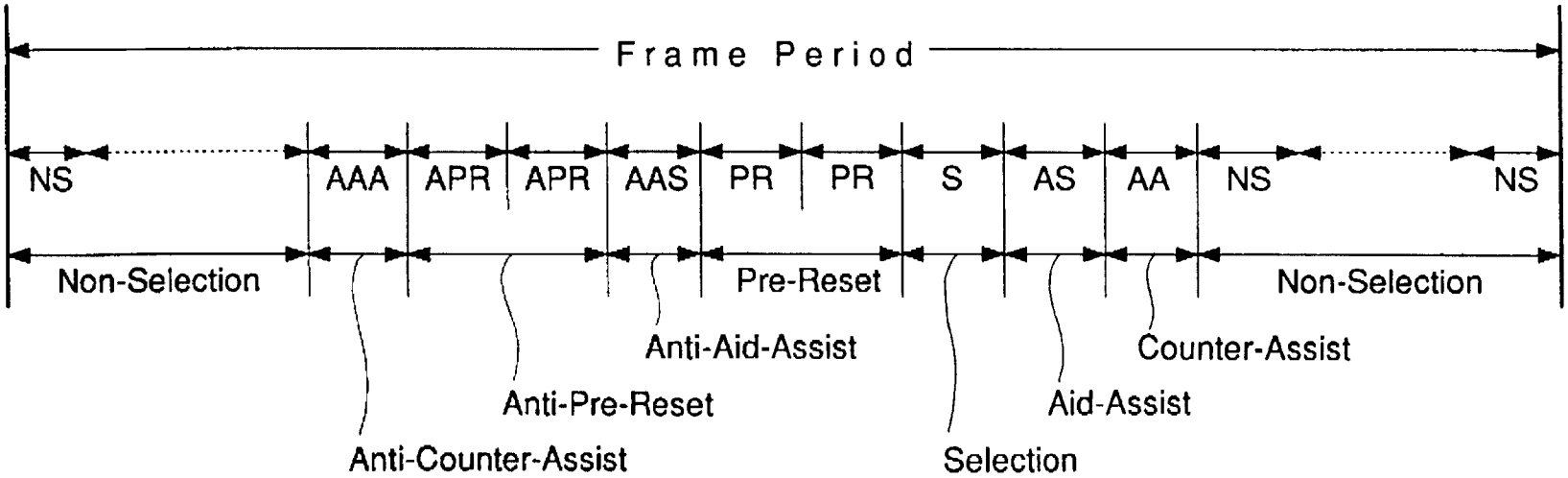
FIG. 6 is a chart showing the sequence example of the scanning signals of a second embodiment of the invention which is adapted to the two-pulse method. In the Figure, AS denotes the aid-assist signal and AAS denotes the anti-aid-assist signal, (these abridged denotations being used throughout the specification and drawings)
Figure 7A:
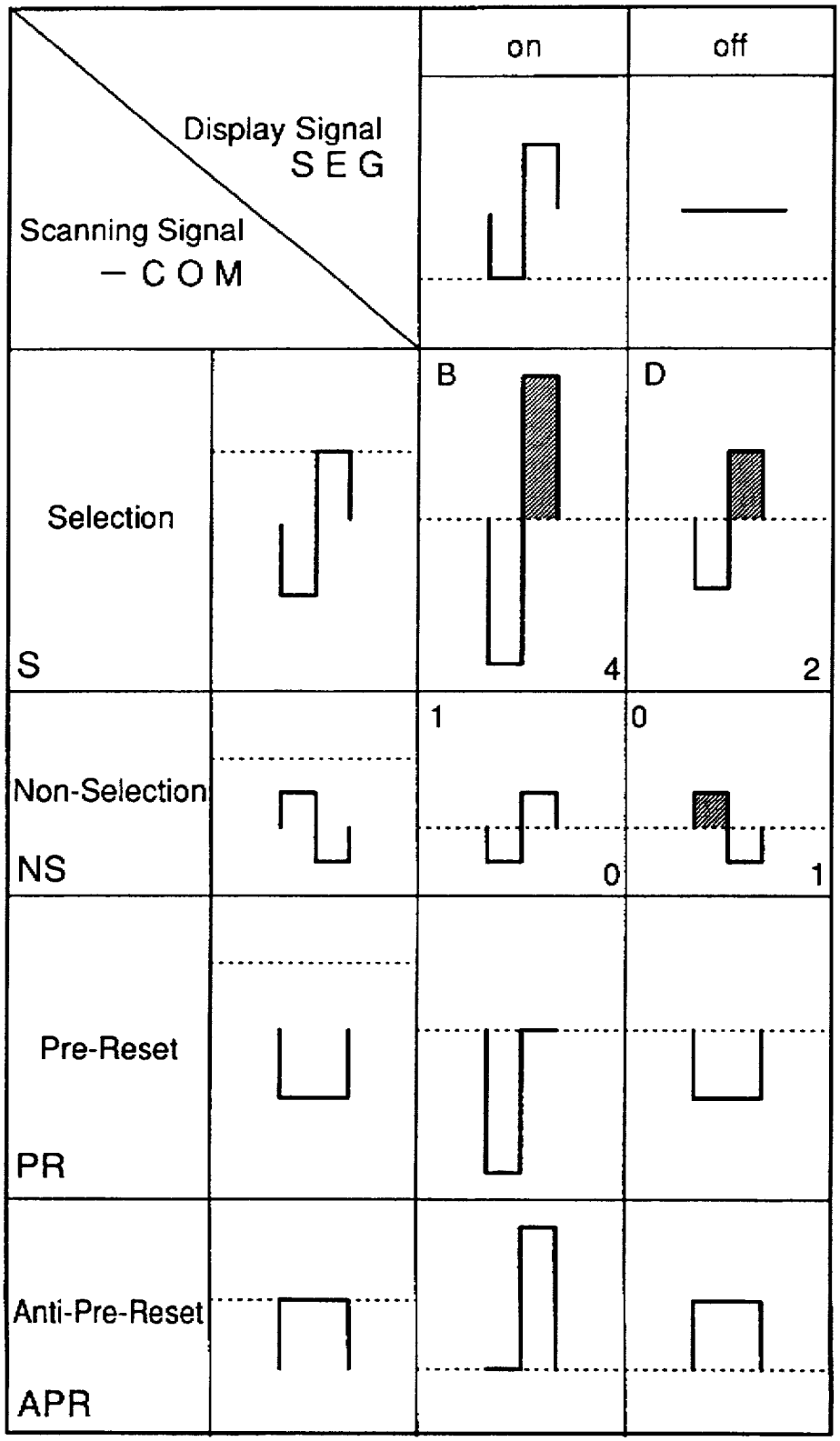
FIGS. 7A, 7B show the wave forms of drive signals in the second embodiment.
Figure 7B:
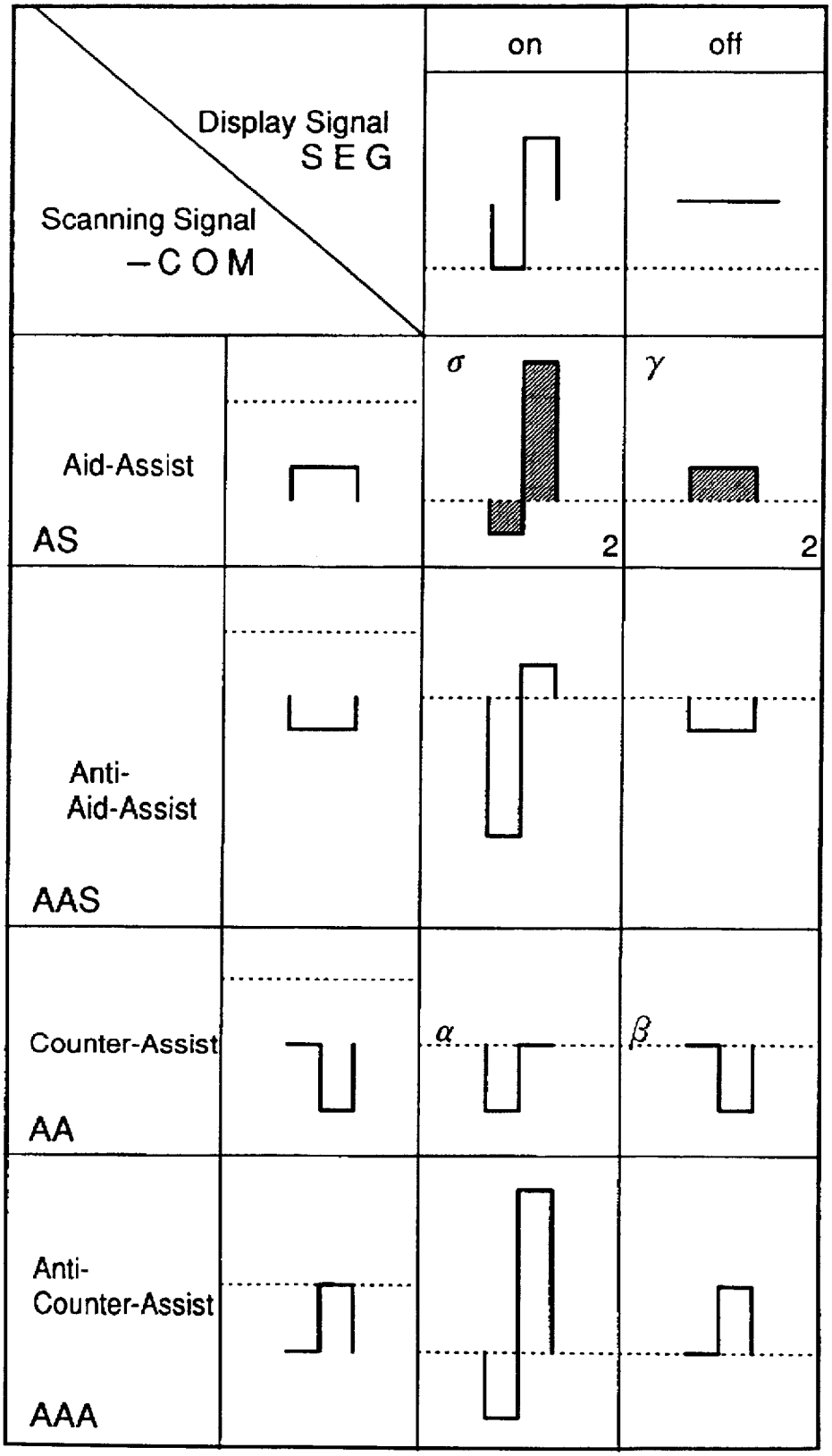
Figure 8:
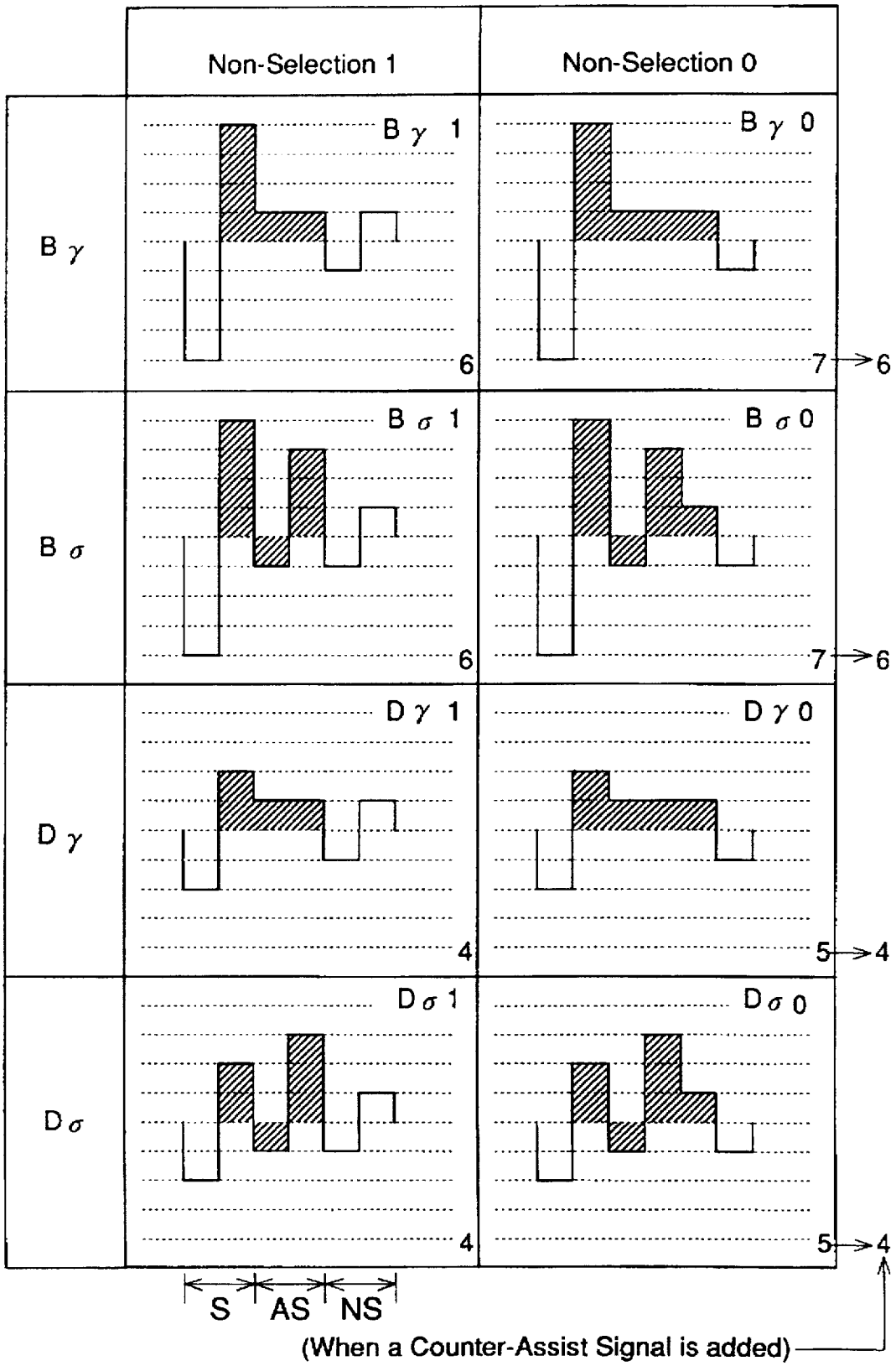
FIG. 8 is a diagram showing the wave forms obtained by combining the drive signals of FIGS. 7A, 7B.

FIG. 6 is a chart showing the scanning signal sequence of a second embodiment, FIGS. 7 show the wave forms of respective scanning signals in the second embodiment, and FIG. 8 is a diagram showing examples of the signal combinations from which the counter-assist signal is excluded. In this embodiment, an aid-assist signal AS having a polarity the same as that of the effective pulse of the selection signal is interposed after the application of the effective pulse. By the addition of this signal AS, the pulse area contributing for writing to brightness is increased to result in speed-up of the operation.

The aid-assist signal AS used herein has the wave form as shown in FIGS. 7, and the wave forms of the picture element driving voltage obtained by the combinations with the ON, OFF of the display signal are represented, respectively, by $\gamma$, $\alpha$. When the counter-assist signal AA is interposed after this aid-assist signal AS, the driving electric voltage applied on the picture element never takes a positive value. FIG. 8 shows the wave forms under the condition that no counter-assist signal AA is applied, but the pulse area which contributes for writing will be always limited by the counter-assist signal AA when the counter assist signal AA is interposed between the aid-assist signal AS and the non-selection signal NS. Accordingly, when the non-selection signal is "1" (cases shown in the left column of FIG. 8), the pulse areas are not changed by the addition of the counter-assist signal AA. However, when the non-selection signal is "0" (cases shown in the right column of FIG. 8), the pulse areas are decreased to 6 or 4 by the addition of the counter-assist signal AA.

Without the addition of the counter-assist signal AA, the pulse area is changed 5→6 in response to the change of Dγ0→Bα1 so that the drive margin index takes a very severe value of 6/5. However, by the addition of the counter-assist signal AA, according to this embodiment, changes in pulse area are 4→6 for every case for the change of darkness→brightness. It should thus be understood that the drive margin index takes a considerably improved value of 6/4.

Meanwhile, in this embodiment, since the pulse area for changing from darkness to brightness becomes larger by the addition of the aid-assist signal AS, not only the drive margin index is further improved but also it becomes possible to increase the switching speed of each picture element without raising the voltage of the drive signal. Alternatively, addition of the aid-assist signal AS is not limited only at the time immediately after the application of the selection signal S, but may be effected immediately before the application of the effective pulse of the selection signal S or before and after the application of the effective pulse.

Figure 9:
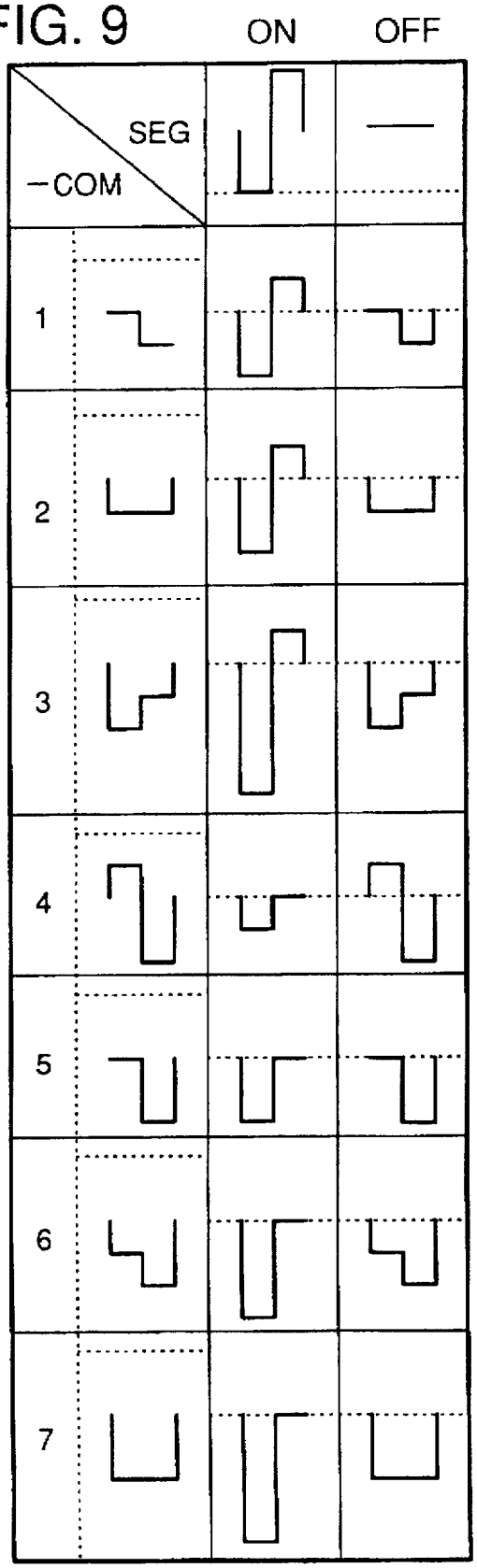
FIG. 9 is a diagram showing modified examples of the wave forms of the counter-assist signal.
Figure 9:
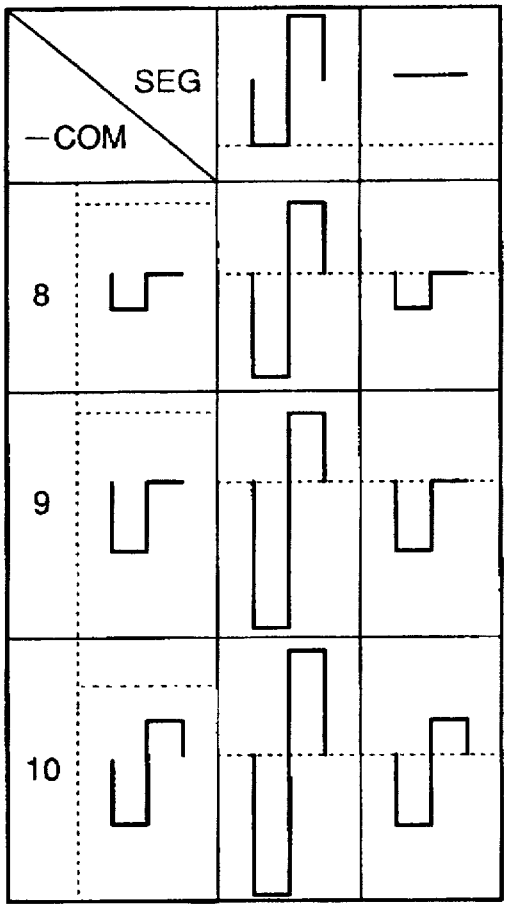
Figure 9:
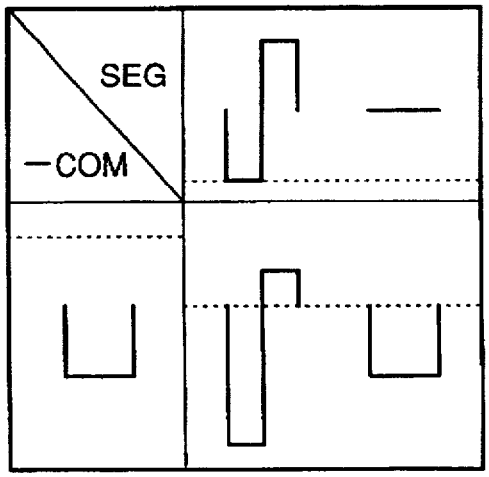

FIG. 9 shows modified examples of the wave form of Counter-assist signal, which may be used in the present invention, and the scanning signal (-COM) 1 is the wave form used in the preceding embodiment. Preferable wave forms are those denoted by 1, 2, 3, 5, 6 and 7, and the most preferable being the wave forms denoted by 1, 2 and 5.

The illustrated wave forms are examples in the 1/4 bias method, and they are reformed as the bias is varied. Since the illustrated wave forms are proposed in the premise that a multi-channel parallel analog switch is used, the electric voltages thereof have been limited to 4 to 5 level. However, without such a premise, further variations may be taken into account.

A method wherein an appropriate negative electric voltage is applied for a moment (for about 2τ) may be anticipated, and the wave in such a method is shown in the lower right portion of FIG. 9. The negative electric voltage used therein is preferably set to a level lower than the voltage level at the selection step. The substance of this wave form is to establish the negative bias condition for a moment immediately after the selection step, and the wave form is not limited only to these illustrated variations. It suffices that the anti-counter-assist signal AAA has a wave form for cancelling the direct current component of the corresponding counter-assist signal AA. In the simplest mode, a wave form inverse to the polarity of the counter-assist signal AA may be added.

Figure 10:
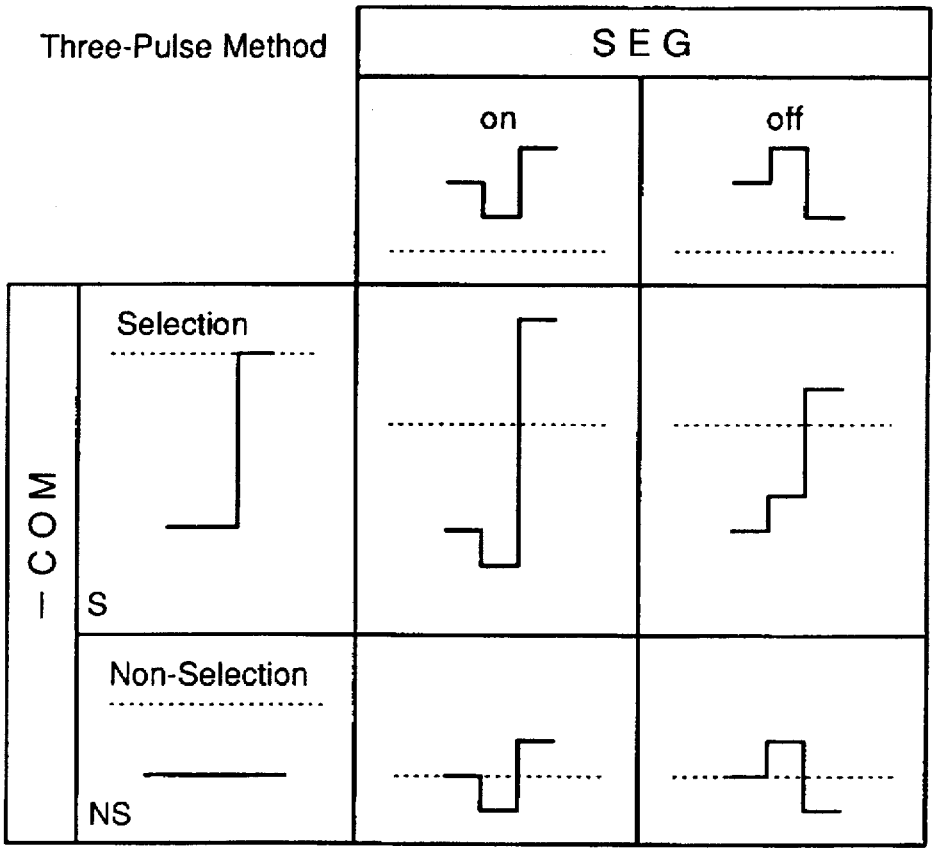
FIG. 10 PRIOR ART
FIG. 10 shows the driving wave forms in an example of a three-pulse driving method according to the prior art technology.
Figure 10:
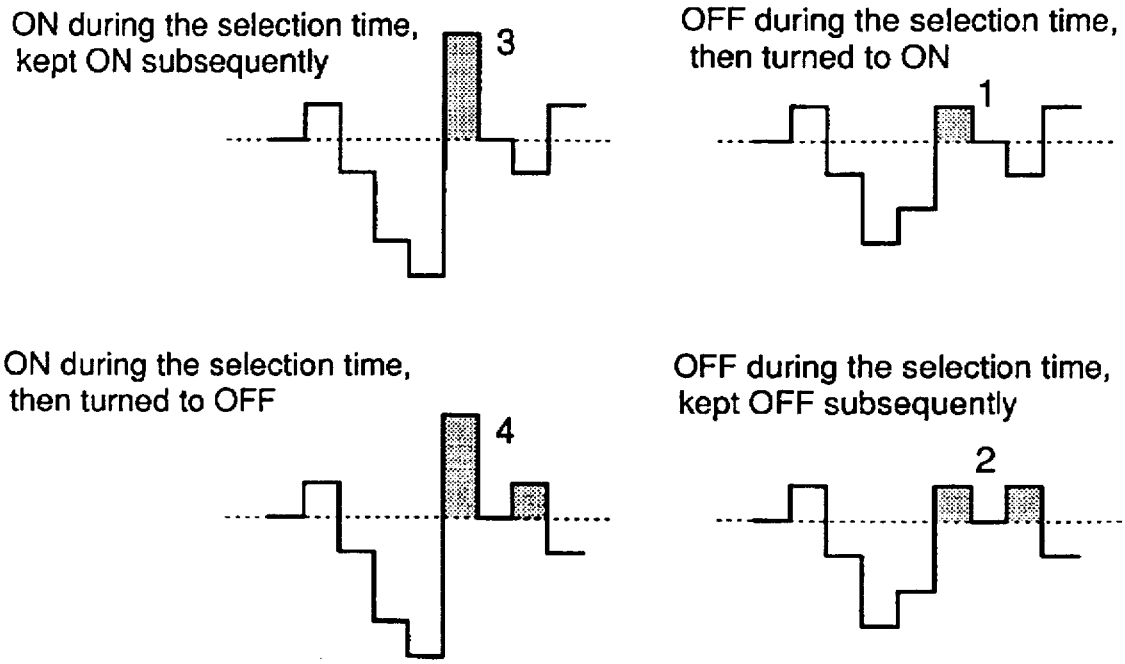
FIG. 10 PRIOR ART
Figure 11:
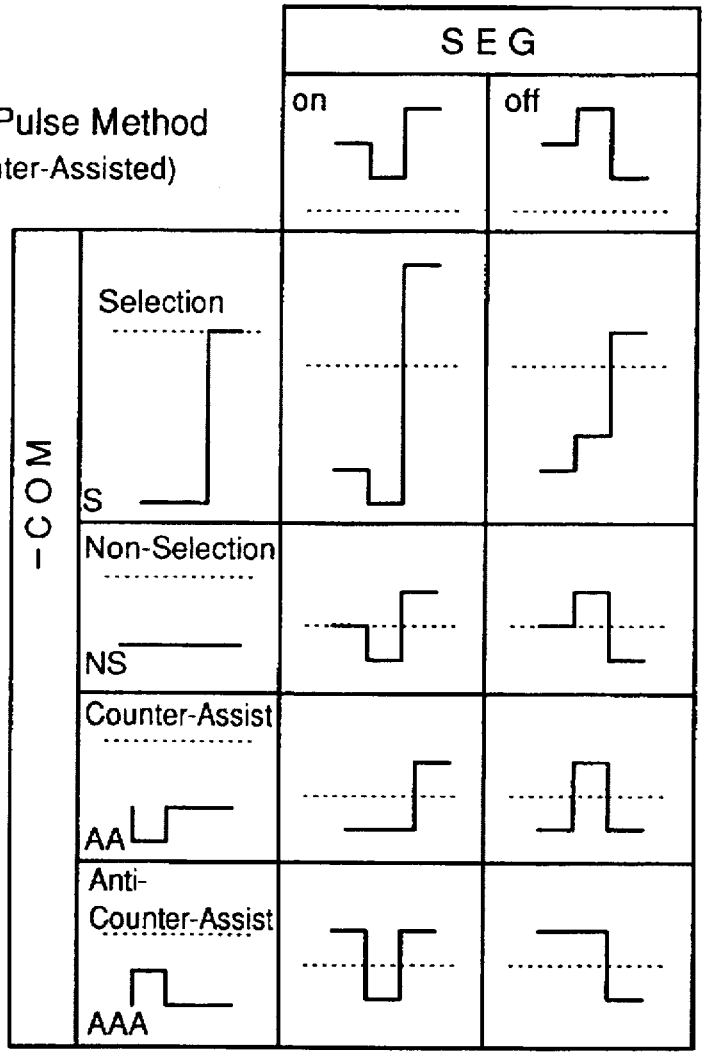
FIG. 11 shows the driving wave forms in third embodiment where the counter-assist signal according to the invention is applied to the three-pulse driving method.
Figure 11:
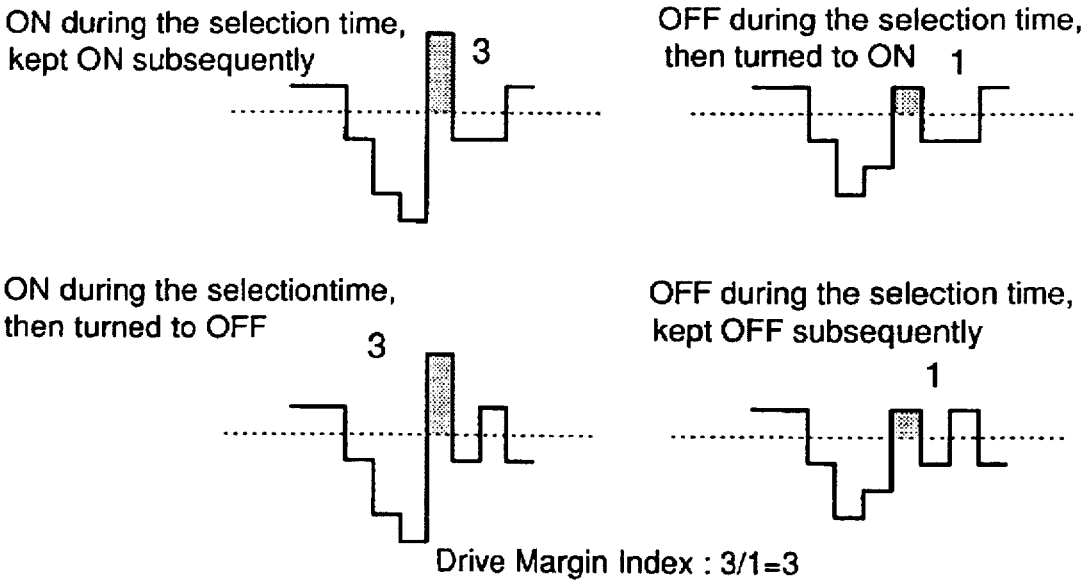
Figure 12A:
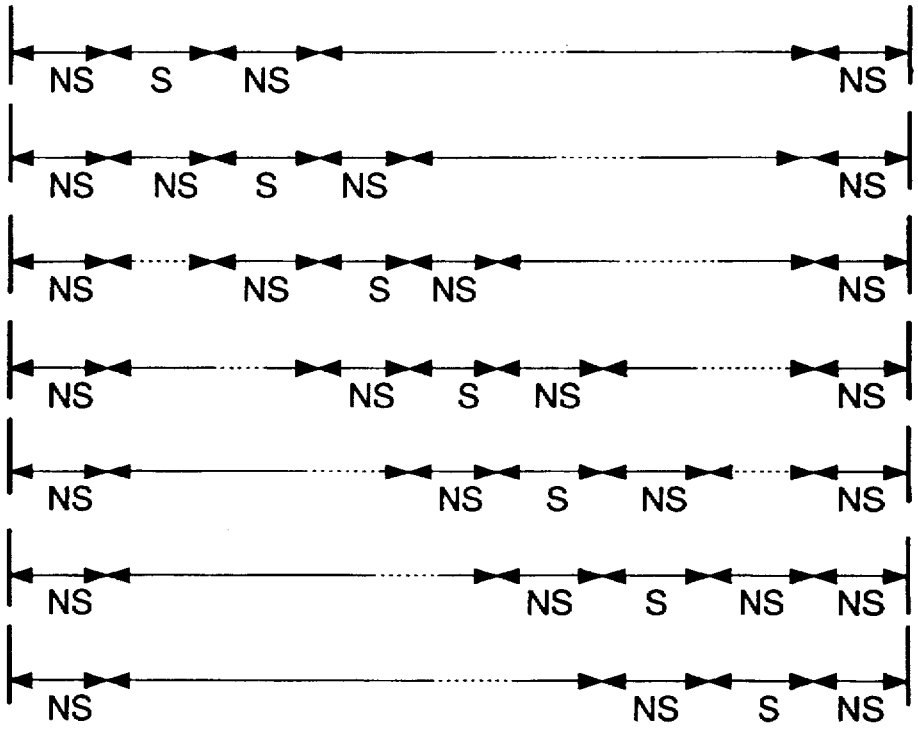
FIG. 12A PRIOR ART
FIG. 12A is an illustration showing sequence examples in the prior art three-pulse driving method.
Figure 12B:
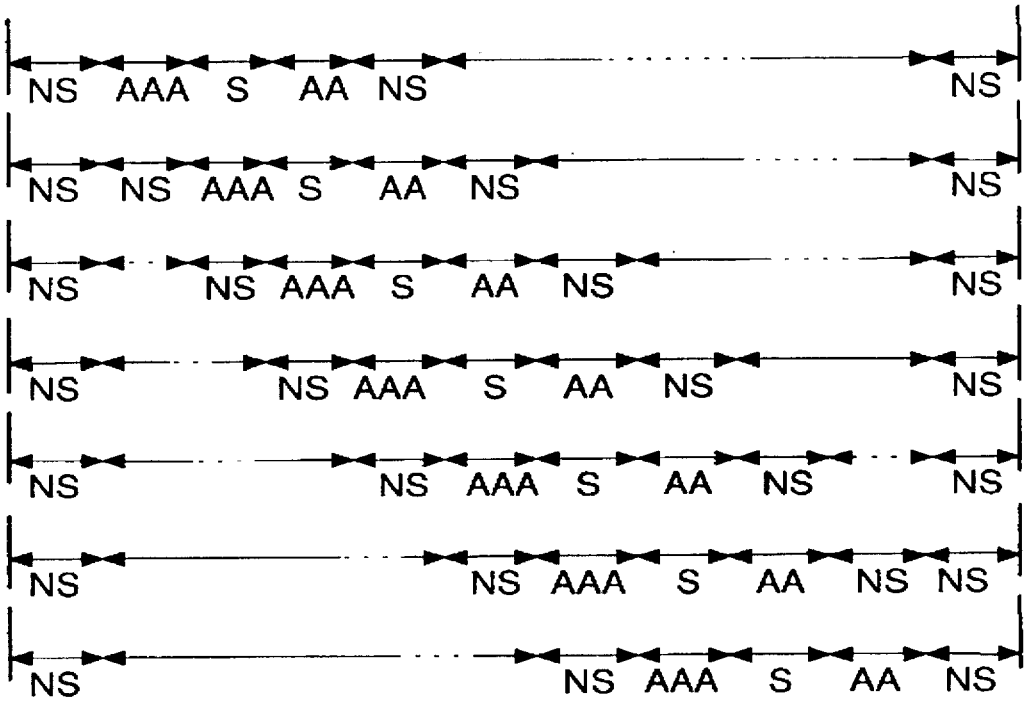
FIG. 12B is an illustration showing sequence examples in the three-pulse driving method wherein counter-assist signals are applied according to (the third embodiment)

A third embodiment of the present invention is applied to the three-pulse driving method; and FIG. 10 is an illustration showing the wave forms in an exemplified prior art three-pulse driving method, FIG. 11 shows the driving wave forms in a case where the third embodiment is applied, and FIGS. 12 show sequence examples in a similar prior art method and in the method according to the third embodiment. In such a three-pulse driving method, the drive margin index, which is 1.5 in the prior art method, can be remarkably increased to 3.0 by the third embodiment of the present invention.

Figure 13:
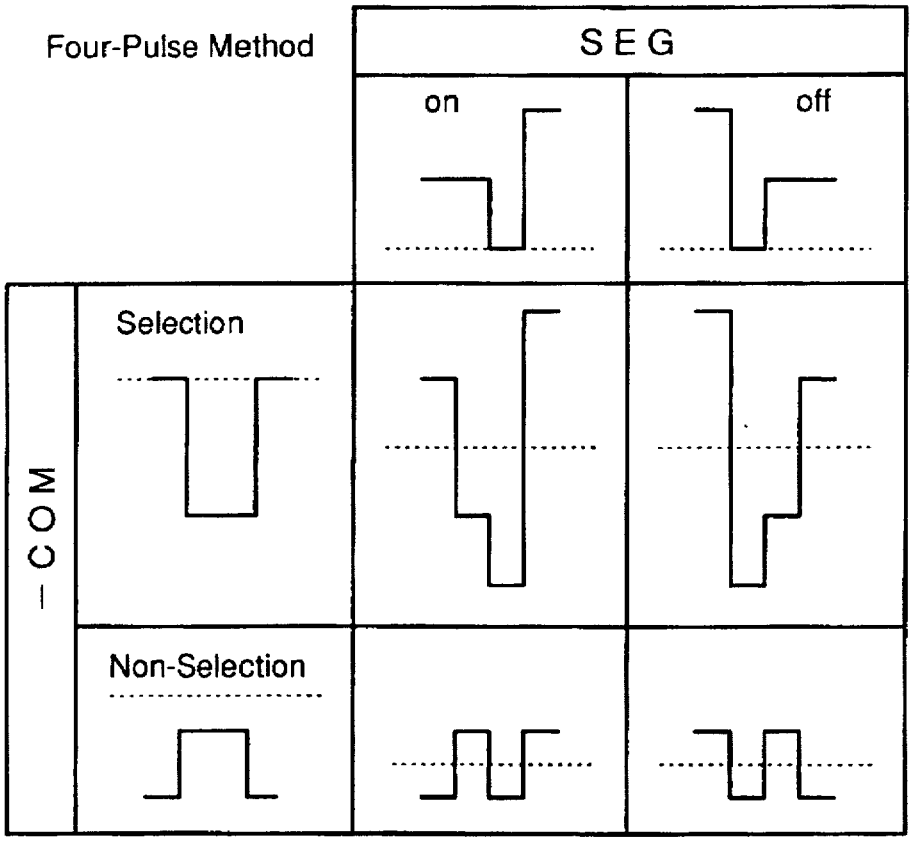
FIG. 13 PRIOR ART
FIG. 13 is an illustration showing the driving wave forms in a prior art four-pulse driving method.
Figure 13:
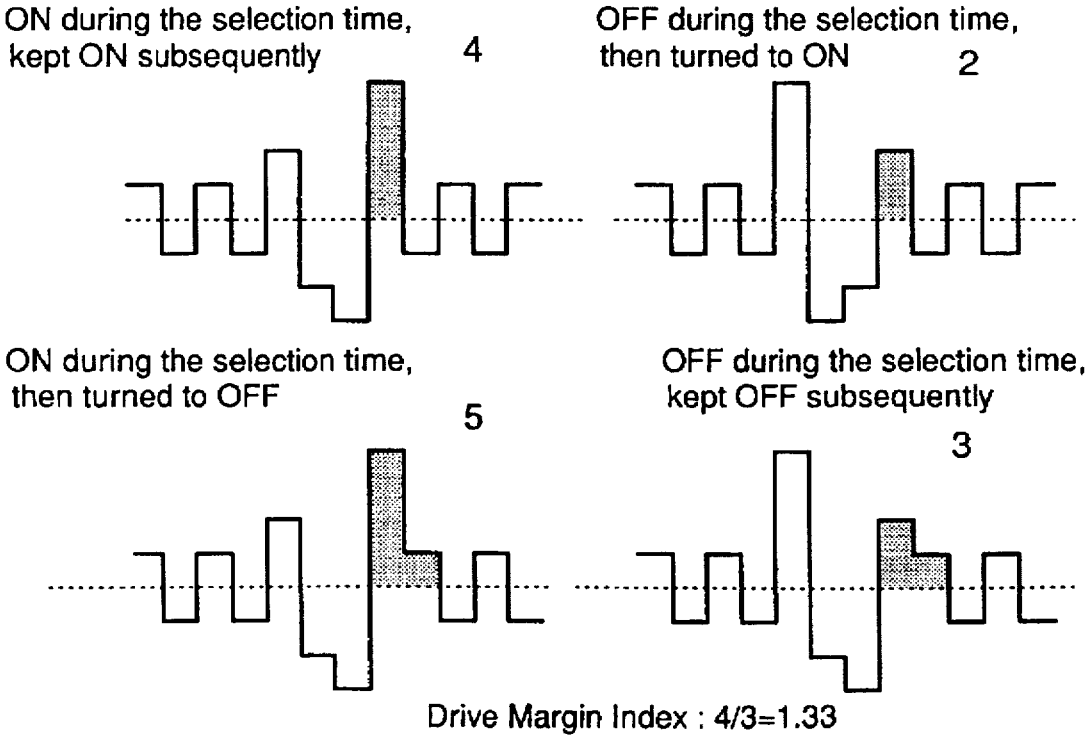
FIG. 13 PRIOR ART
Figure 14:
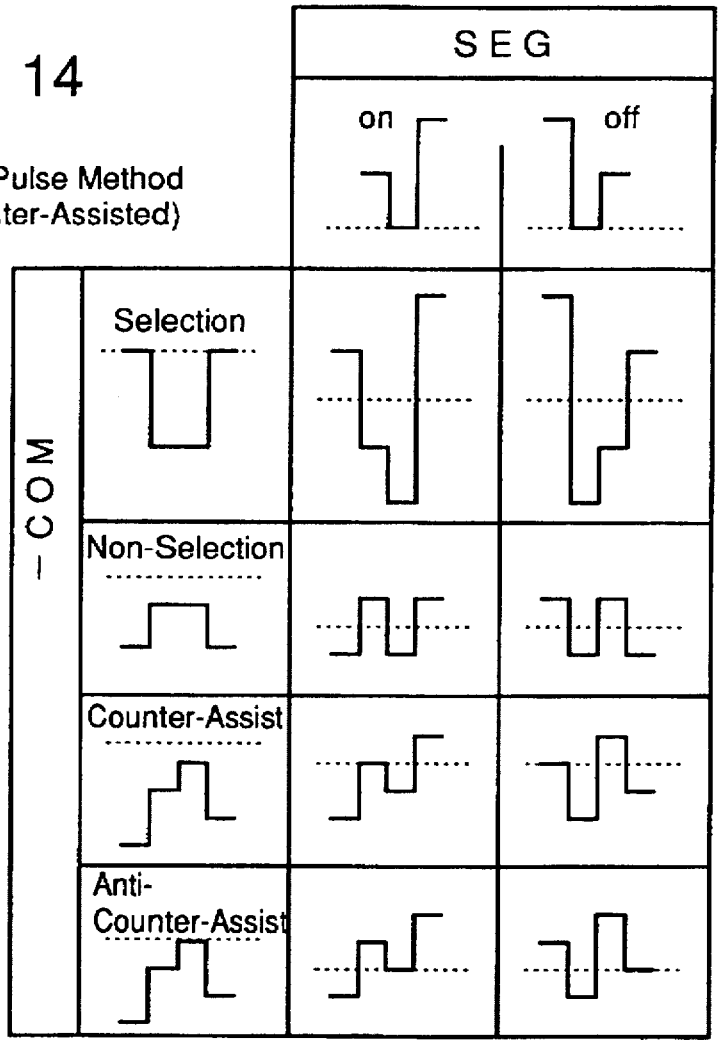
FIG. 14 is an illustration showing the driving wave forms in fourth embodiment where a counter-assist signal is applied, according to the invention, to the four-pulse driving method.
Figure 14:
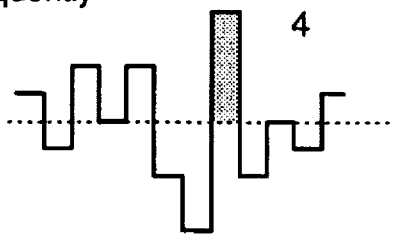
Figure 14:
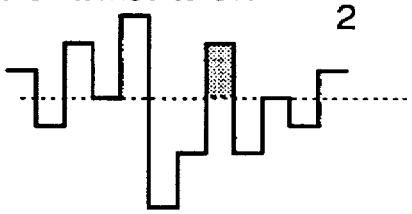
Figure 14:
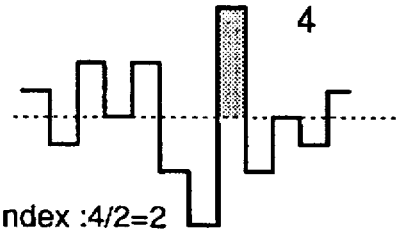
Figure 14:
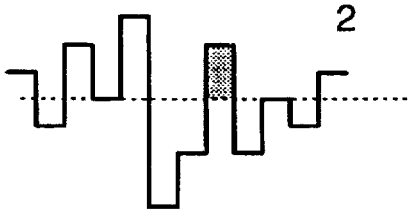
Figure 15A:
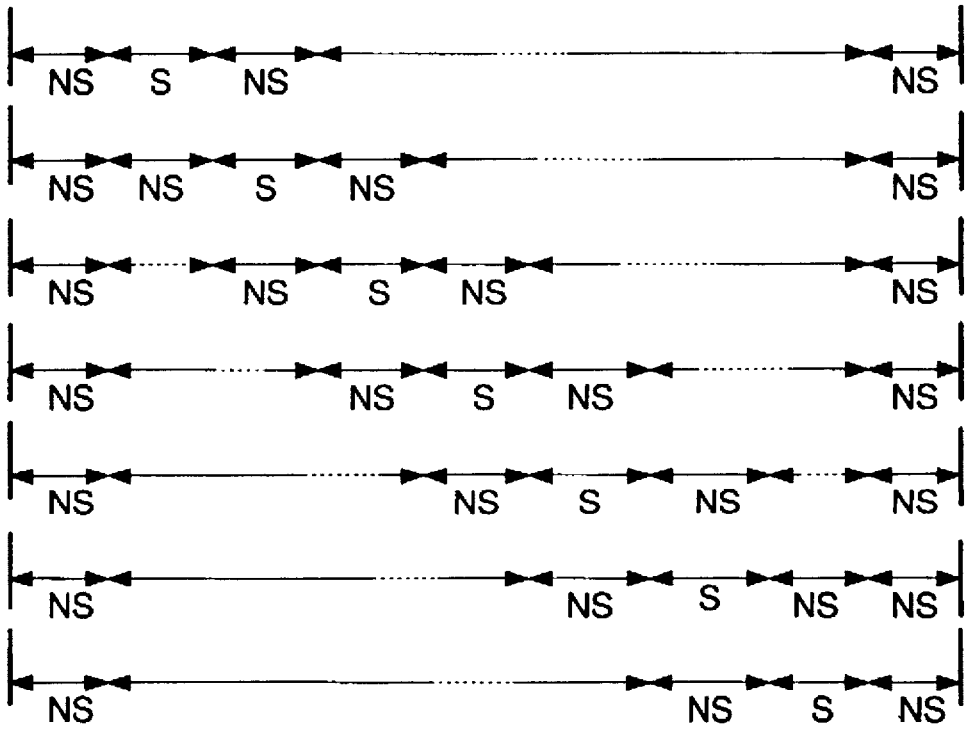
FIG. 15A PRIOR ART
FIG. 15A is an illustration showing sequence examples in the prior art four-pulse driving method.
Figure 15B:
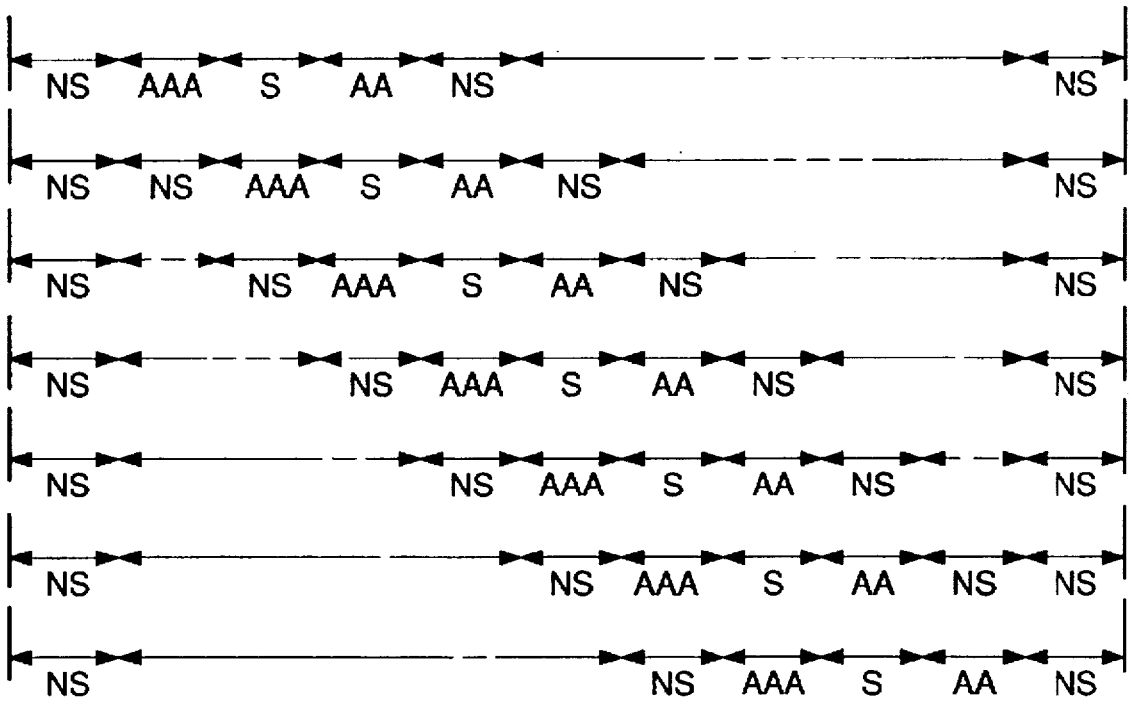
FIG. 15B is an illustration showing sequence examples in the fourth embodiment where a counter-assist signal is applied, according to the invention, to the four-pulse driving method.

A fourth embodiment of the present invention relates to a four-pulse driving method; and FIG. 13 is an illustration showing the wave forms in the prior art method, FIG. 14 is an illustration showing the driving wave forms in a case where the fourth embodiment is applied, and FIGS. 15*a* and 15*b* are illustrations showing the sequence examples in the prior and in the method of the fourth embodiment. In such a four-pulse driving method, the drive margin index, which is 1.33 in the prior art method, can be increased to 2.0.

Figure 16:
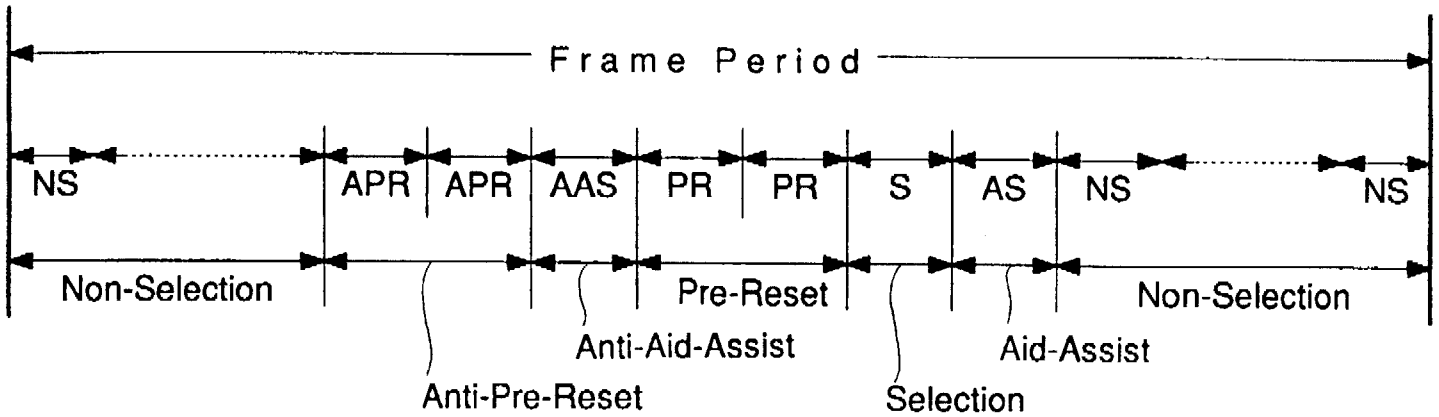
FIG. 16 is a chart showing the scanning signal sequence in a fifth embodiment of the invention which is applied to a 1/4 bias two-pulse driving method.
Figure 17:
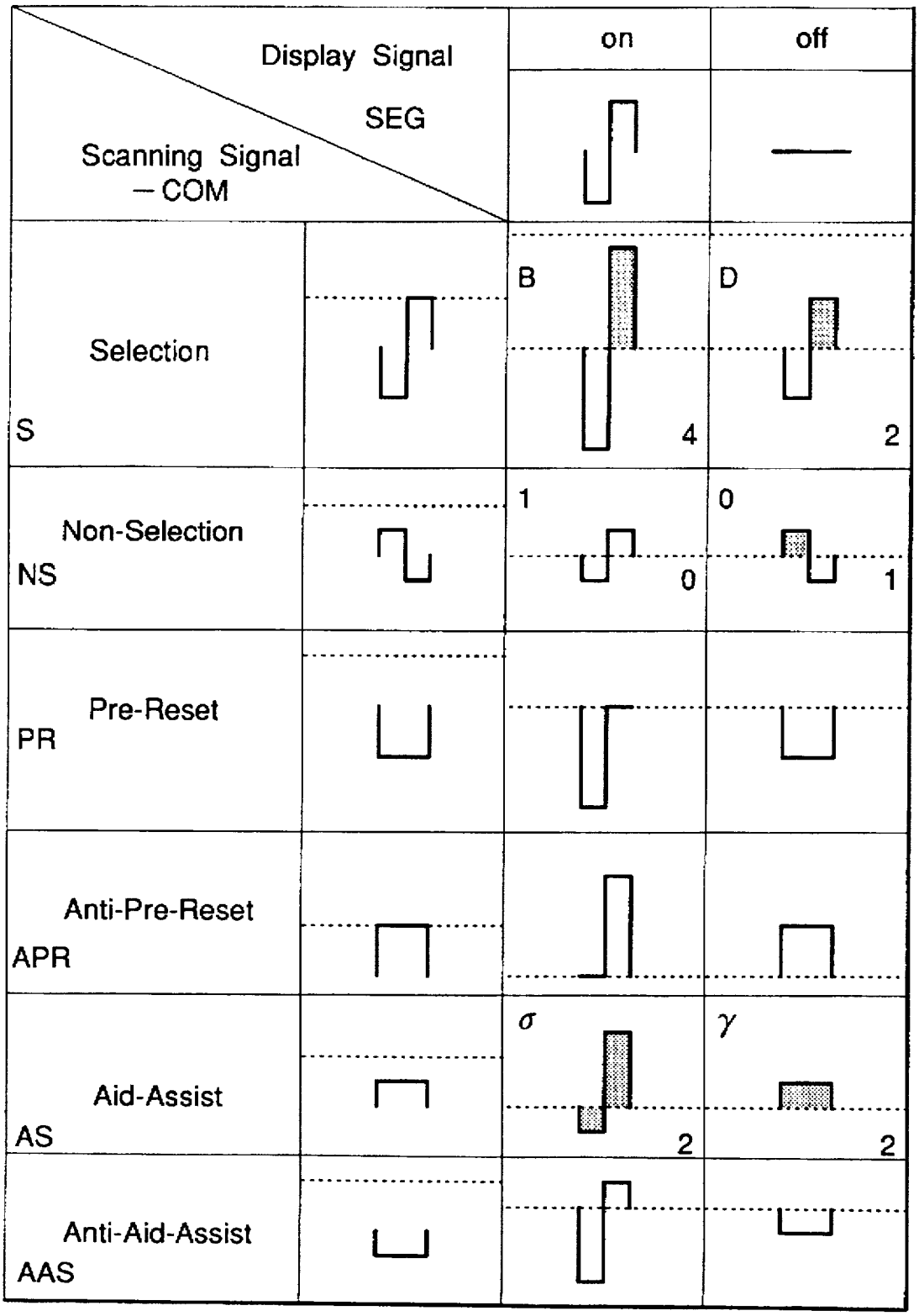
FIG. 17 is a diagram showing the wave forms of the drive signals in the fifth embodiment of the invention.
Figure 18:
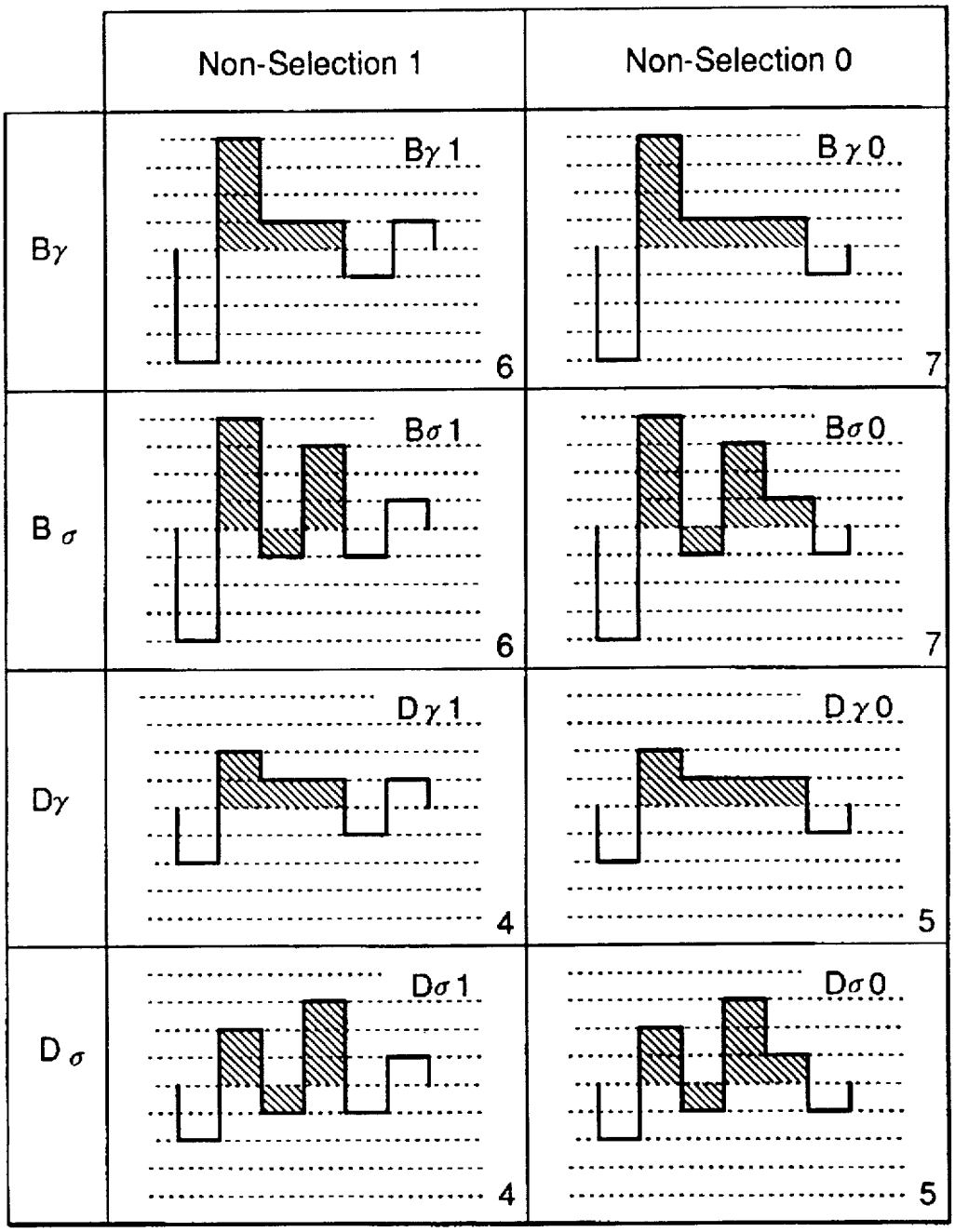
FIG. 18 is a diagram showing the difference in wave form of the drive signals which are obtained by combining respective signals.
Figure 20:
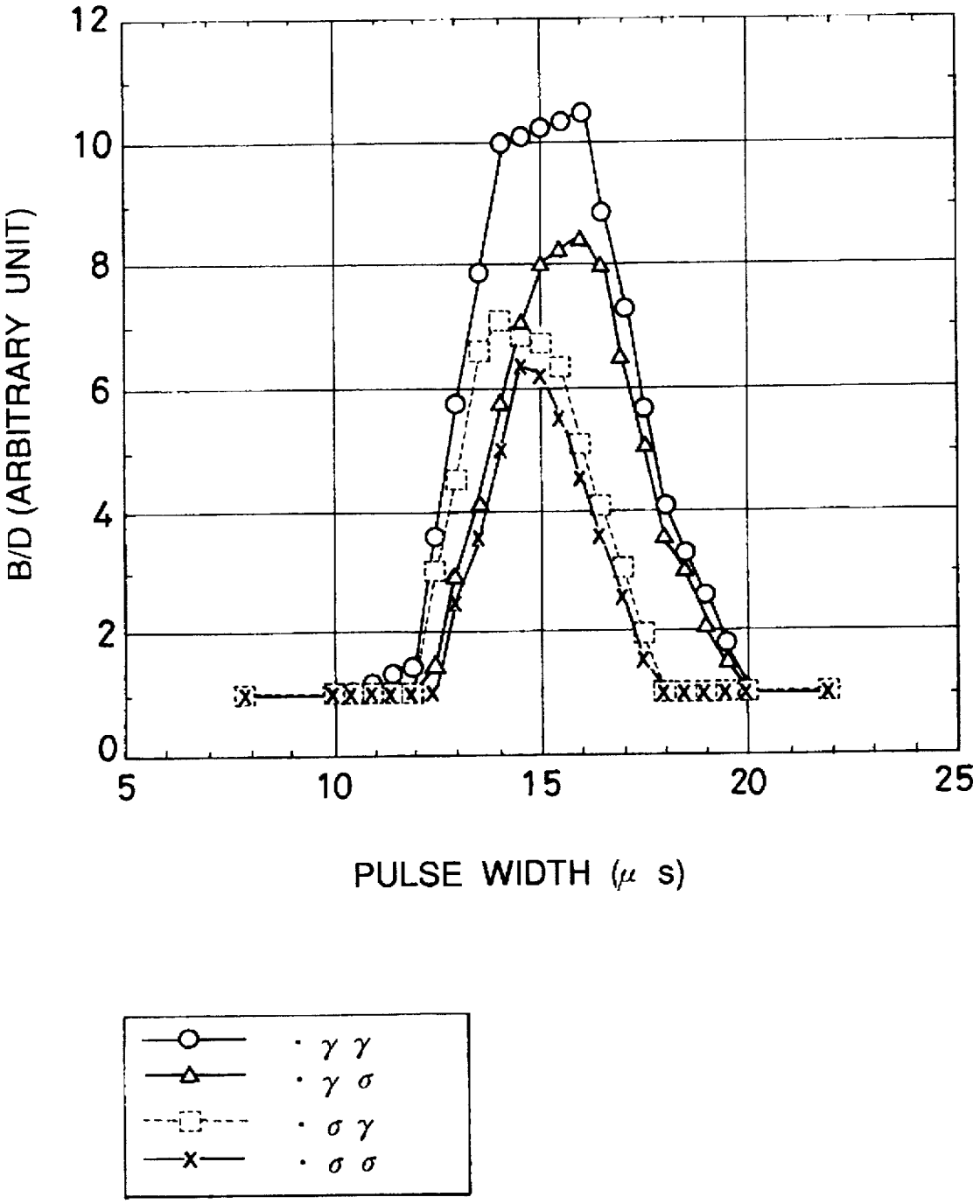
FIG. 20 is a representation showing the results of experiment of the fifth embodiment.
Figure 21A:
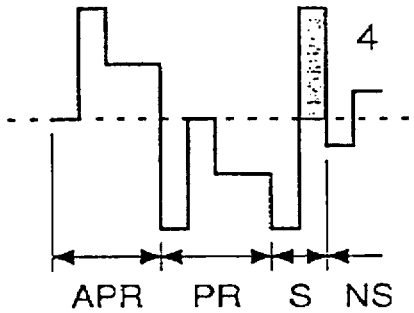
FIG. 21A PRIOR ART
FIGS. 21(*a*) and 21(*b*) are illustrations showing, in comparison, the wave forms of signals in the 1/4 bias two-pulse driving methods, FIG. 21(*a*) is a prior art method and FIG. 21(*b*) is the fifth embodiment of the invention. The prior art is shown in FIG. 21(*a*), whereas the embodiment of the invention is shown in FIG. 21(*b*)
Figure 21A:
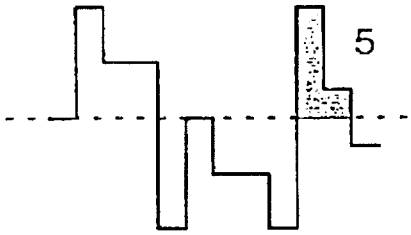
FIG. 21A PRIOR ART
Figure 21A:
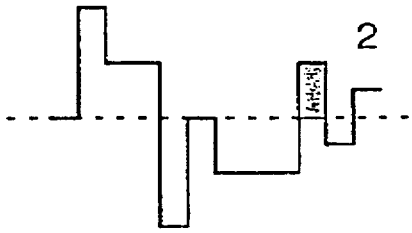
FIG. 21A PRIOR ART
Figure 21A:
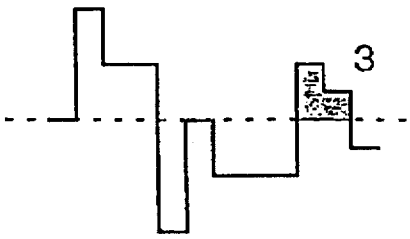
FIG. 21A PRIOR ART
Figure 21B:
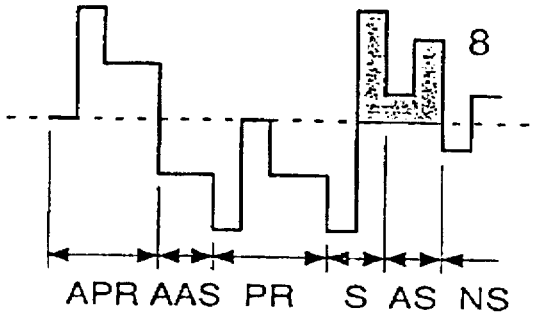
Figure 21B:
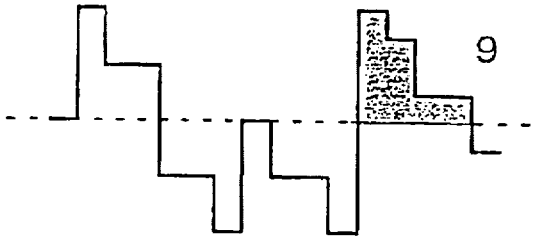
Figure 21B:
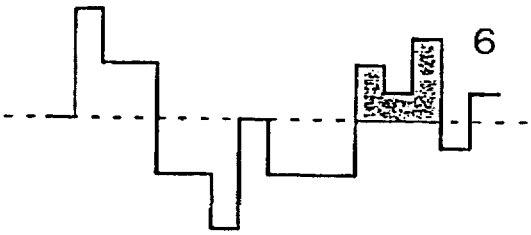
Figure 21B:
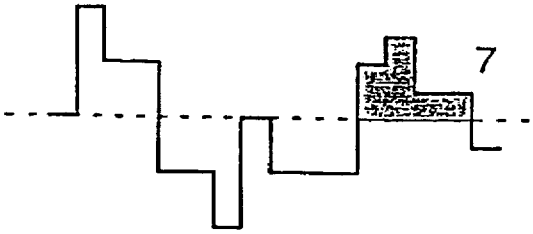
Figure 35:
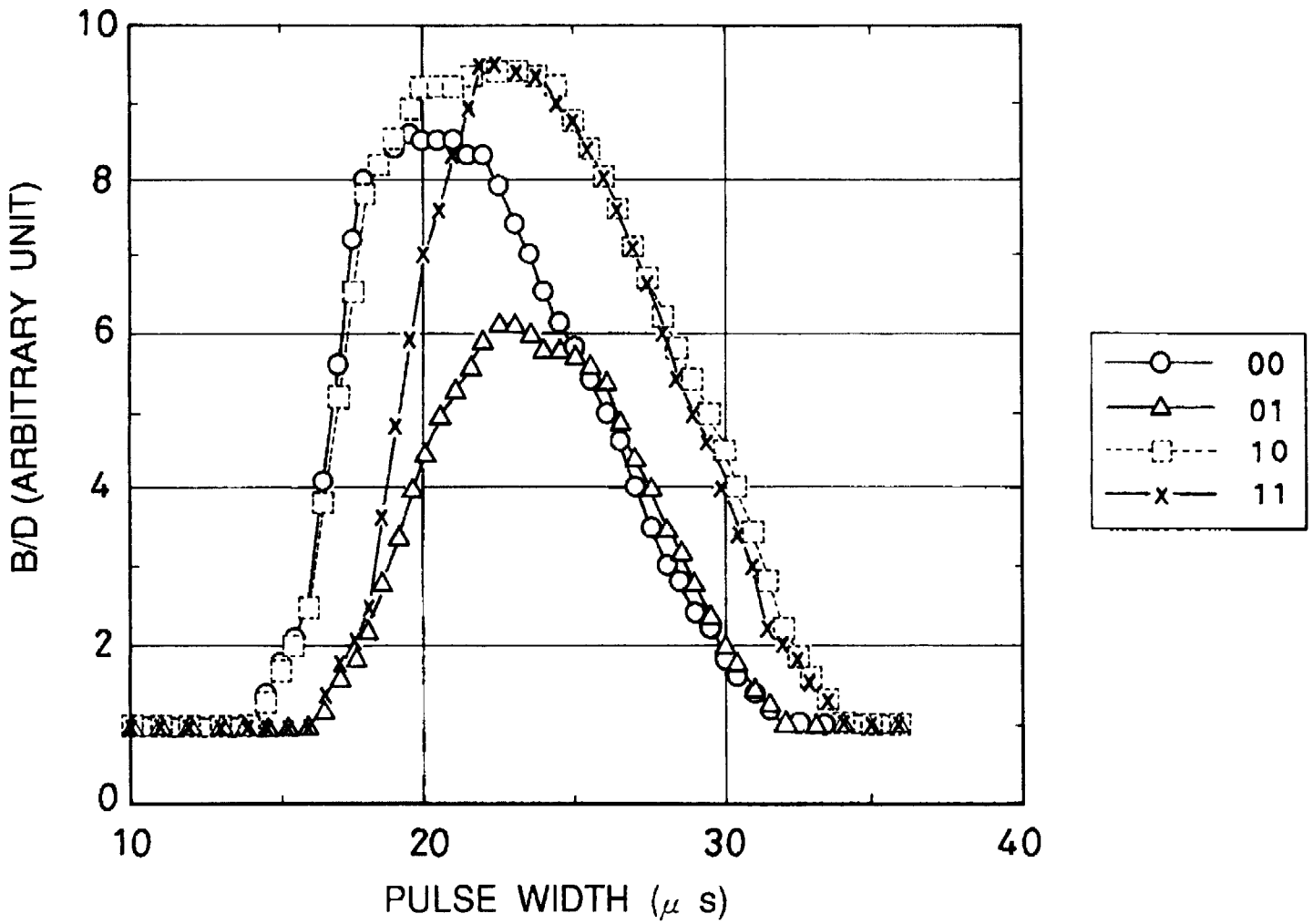
FIG.35 PRIOR ART
FIG. 35 is a graphic representation showing the results of an experiment conducted in accordance with the prior art technology of FIG. 32.

FIG. 16 is a chart showing an example of the scanning signal sequence in a fifth embodiment of the present invention which is applied to the 1/4 bias two-pulse driving method, FIG. 17 is a diagram showing the wave forms of the drive signals applied on the picture element, FIG. 18 is a diagram showing the difference in wave form of drive signals depending on the combination of respective signals, FIG. 19 is a diagram showing the change in pulse area at the time of rewriting from darkness to brightness, and FIG. 20 is a representation showing the results of an experiment wherein the change of the contrast B/D in terms of the pulse width has been measured. The experiment of FIG. 20 was conducted under conditions the same as those of the preceding experiment for finding the results of FIG. 35.

The scanning signal comprises, as shown in FIG. 16, a selection signal S, two pre-reset signals PR and two anti-pre-reset signals APR interposed immediately before the selection signals, an aid-assist signal AS added immediately after the selection signal S, an anti-aid-assist signal AAS interposed between the anti-pre-reset signal APR and the pre-reset signal PR, and multiple non-selection signals NS. As will be apparent from FIG. 17, the signals other than the aid-assist signal AS and the anti-aid-assist signal AAS have the same wave forms as described by referring to the preceding FIG. 32, and the descriptions thereof will not be repeated here.

The anti-pre-reset signal APR is applied to cancel the direct current component of the pre-reset signal PR. The anti-aid-assist signal AAS is interposed to cancel the direct current component of the aid-assist signal AS.

The aid-assist signal AS has, as shown in FIG. 17, a time duration same as that of the selection signal S at the electric voltage 1. The wave form of the drive signal obtained when the display signal is ON at the timing of output of the aid-assist signal AS will be represented by "σ", and the wave form of the drive signal obtained when the display signal is OFF will be represented by "ν". Meantime, in FIG. 17, pulse areas (effective values) are shown at the lower right positions below some of the drive signal wave forms.

The combinations of these signals are shown in FIG. 18. For instance, when an aid-assist signal ν and a signal "1" as the non-selection signal NS are applied in combination after the signal "B" for rewriting to brightness, the drive signal applied on the picture element is represented by "Bν1" and has the wave form as shown in FIG. 18. In this case, an aid-assist signal ν having an electric voltage of 1 is added following the pulse contributing for rewriting to brightness, namely the effective pulse P having an electric voltage of 4, whereby the pulse area (hatched portion) contributing for rewriting to brightness takes a value of 4+2=6. Likewise, the pulse areas contributing for writing for respective combinations are shown in the lower right position of respective wave forms.

As will be apparent from FIG. 18, the pulse area (effective value) at the time of rewriting the reset dark state to brightness becomes 6 or 7, and the pulse area for keeping the dark state is 4 or 5. Thus, the pulse area for rewriting to brightness increases considerably as compared to the pulse area of 4 or 5 (see FIG. 34) in the prior art method. It should be understood that high speed switching can be achieved without increasing the electric voltage of the drive signal.

There are expectable combinations as shown in FIG. 19 for changing darkness to brightness, and from these combinations four combinations (denoted by *) in which the pulse areas for brightness and for darkness are closest with each other have been selected and the contrasts B/D thereof are determined and shown in FIG. 20. In FIG. 20, the cases where rewriting from darkness to brightness, for example, the case of rewriting from Dv to Bv is represented by vv.

From the result of this experiment, it is understood that the range of the pulse width for obtaining an intensive contrast B/D is not more than 20 μsec. Namely, as compared to the prior art method (FIG. 34) described hereinbefore, the pulse width may be set to a smaller value so as to attain speed-up of the switching operation.

The fifth embodiment is a 1/4 bias method wherein the ratio between the electric voltage of the selection signal S for rewriting the picture element to brightness and the electric voltage of the non-selection signal NS for keeping darkness is set to 4:1. FIGS. 21(*a*) and 21(*b*) show the signal wave forms obtained by combining respective signals in the 1/4 bias method. The wave forms in the prior art method wherein no aid-assist signal AS is applied are shown in FIG. 21(*a*), whereas the wave forms obtained by the present invention wherein aid-assist signals AS are added are shown in FIG. 21(*b*).

As will be apparent from FIG. 21(*b*), although the drive margin index, which is the ratio in effective value of brightness to darkness, is 1.33 in the prior art method shown in FIG. 21(*a*), it is lowered to 1.14 to hinder improvement of the image quality. To cope with this problem, the inventor has found that the problem is solved by setting the bias to not less than 1/3.5, preferably not less than 1/2.8. The reason therefor will be described hereinbelow.

Figure 22:
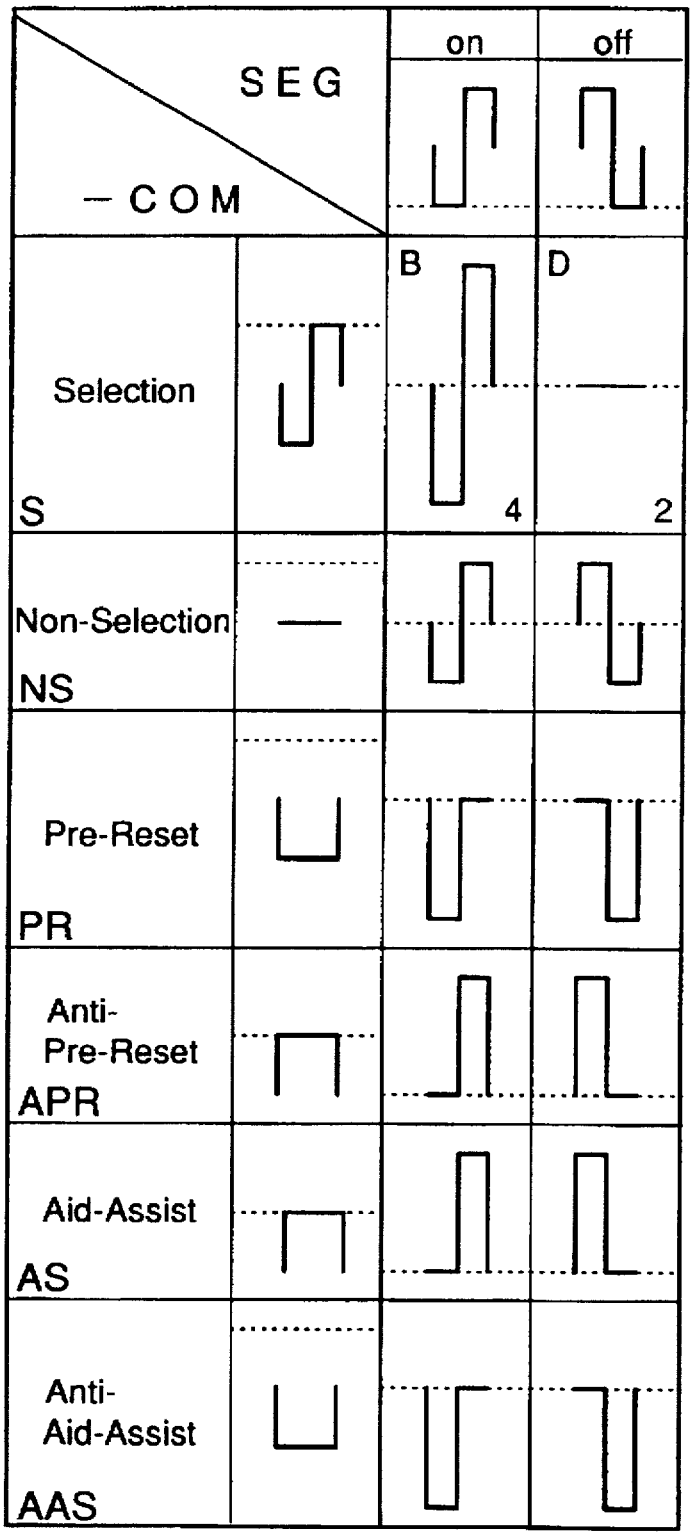
FIG. 22 is a diagram showing the wave forms of respective signals in a case where the aid-assist signal AS of the fifth embodiment is applied to the 1/2 bias two-pulse driving method.
Figure 23A:
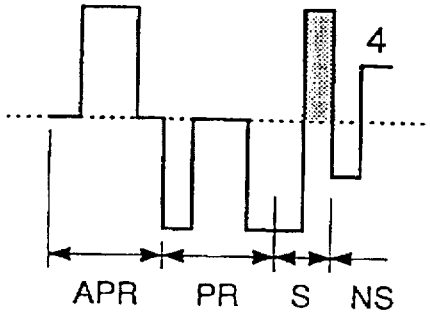
FIG. 23A PRIOR ART
FIGS. 23(*a*) and 23(*b*) are illustrations showing, in comparison, the wave forms of the signals in 1/2 bias two-pulse driving methods, in FIG. 23(*b*) the driving wave forms of FIG. 22 are used and in FIG. 23(*a*) the driving wave forms of the prior art are used. The prior art is shown in FIG. 23(*a*), whereas the embodiment of the invention is shown in FIG. 23(*b*)
Figure 23A:
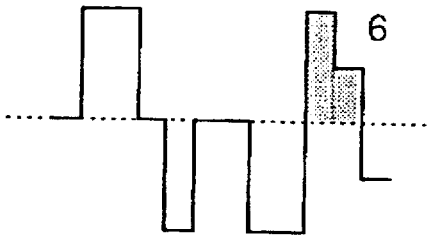
FIG. 23A PRIOR ART
Figure 23A:
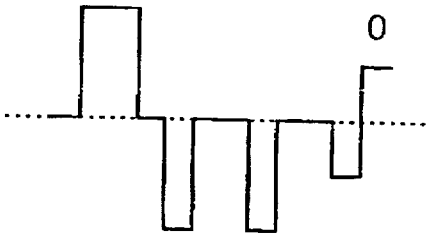
FIG. 23A PRIOR ART
Figure 23A:
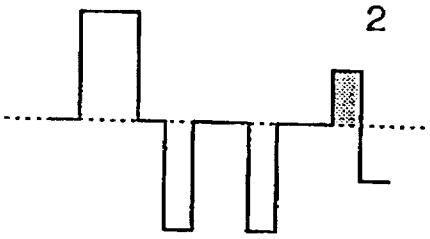
FIG. 23A PRIOR ART
Figure 23B:
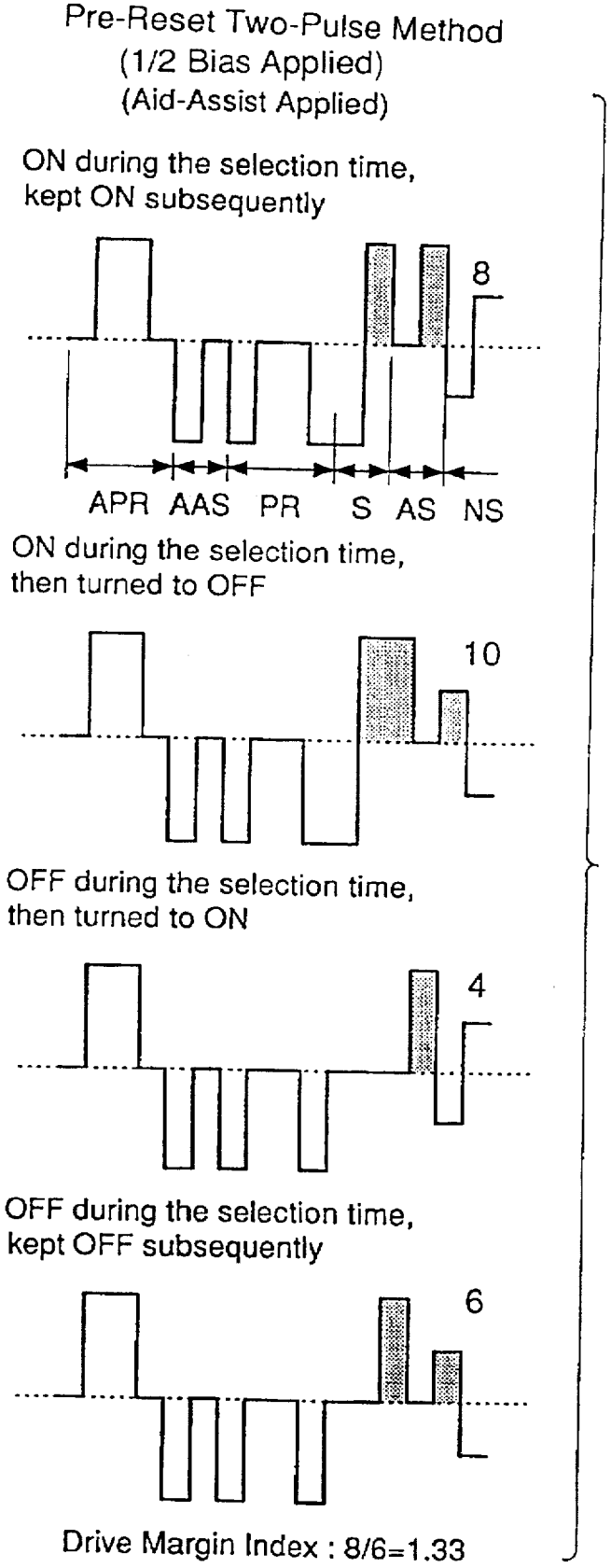

FIG. 22 is a diagram showing the wave forms of respective signals when aid-assist signals AS are added in accordance with the present invention in the 1/2 bias two-pulse method. FIG. 23(*a*) and 23(*b*) show the wave forms of combined signals in such a case, wherein the wave forms in the prior art method using no aid-assist signal AS are shown in FIG. 23(*a*), and the wave forms obtained by the addition of aid-assist signals according to the present invention are shown in FIG. 23(*b*).

Referring to the wave forms in FIG. 23(*b*), the drive margin index becomes 1.33 which is the same as that obtainable in the prior art 1/4 bias method shown in FIG. 21(*a*) to reveal that a sufficiently large margin is assured. When it is intended to inverse the state from dark to bright, an effective value (area intensity) of 4 is needed at the least in the prior art 1/4 bias method (see (A) in FIG. 21(*a*), the minimum or least effective value is 8 in the 1/2 bias method according to the present invention (see (A) in FIG. 23(*b*). Thus, the effective value is doubled as from 4 to 8 according to the present invention, and this means that the scanning speed can be increased as much as two times.

Furthermore, it has been acknowledged that an increase in bias ratio contributes an improvement in contrast. The reason therefor is as follows. During the non-selection time, the picture element is applied with an electric voltage which varies from positive to negative within a predetermined effective value amplitude. In general, increase of the amplitude voltage (namely the effective value) at that time induces minute fluctuations of the liquid crystal at the picture elements particularly when the state is selectively set to dark, leading to increase in quality of light breaking through the picture element. The result is a reduction in contrast, which deteriorates the image quality. However, according to the present invention, the effective value can be set to a smaller value by lowering the electric voltage of the non-selection signal NS since the bias ratio is larger as described above, whereby it becomes possible to intensify the contrast thereby to improve the image quality.

Figure 24:
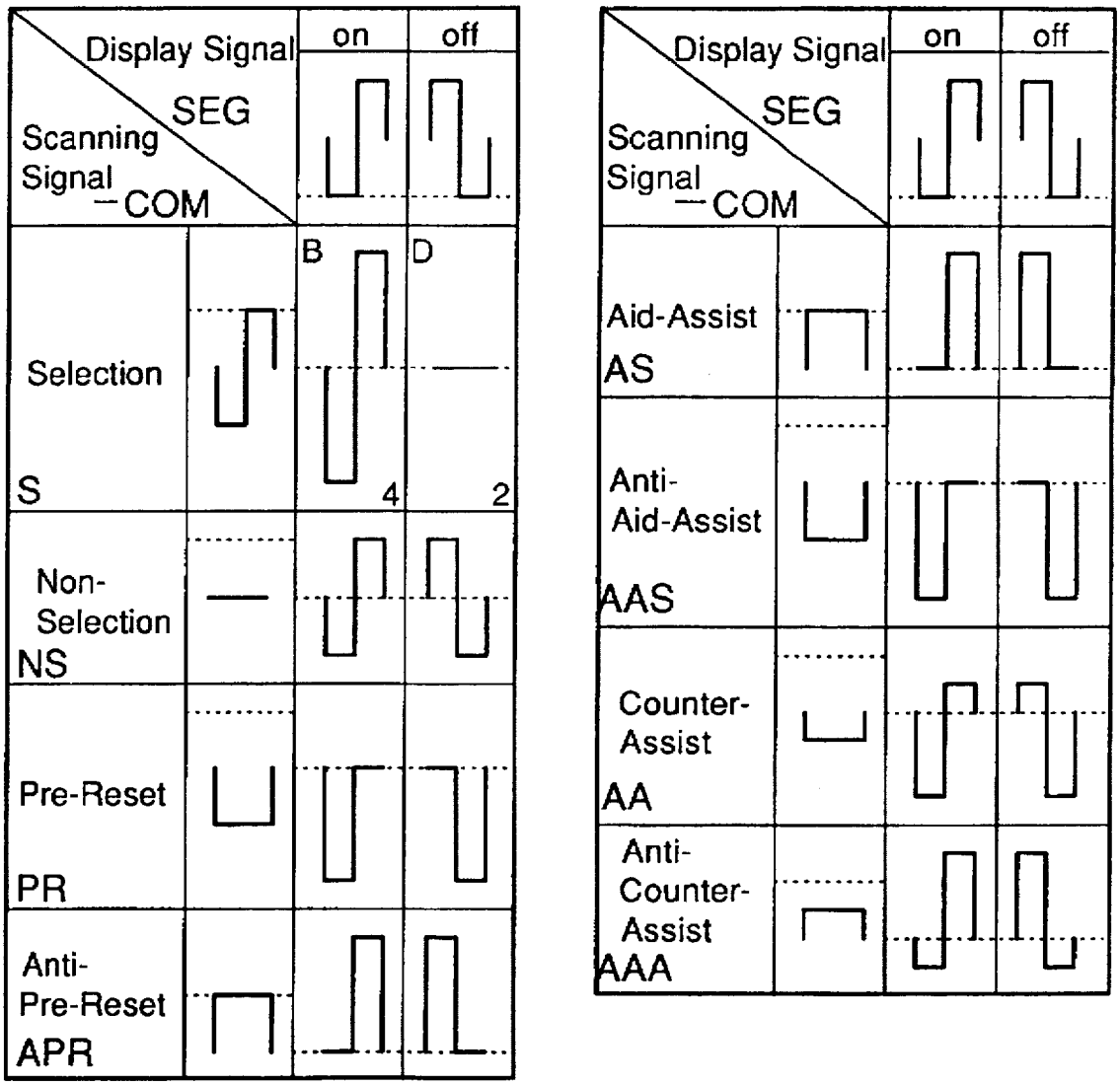
FIG. 24 shows the wave forms in another embodiment of the 1/2 bias two-pulse driving method.

FIG. 24 shows the signal wave forms in another embodiment of the 1/2 bias two-pulse method. A counter-assist signal AA and an anti-counter-assist signal AAA are shown in this Figure. The counter-assist signal AA is interposed immediately after the aid-assist signal AS or immediately after the selection signal S to exert a function of adding a negative pulse voltage before the non-selection signal NS. By the interposition of the counter-assist signal AS, influence by the non-selection signal NS, which follows the aid-assist signal AS, on the effective value (area intensity) produced by the selection signal S and the aid-assist signal AS is prevented.

Further, when the counter-assist signal AA is added, an anti-counter assist signal AAA is added to cancel the direct current component of the counter-assist signal AA. The anti-counter-assist signal AAA is interposed before the pre-reset signal PR. For example, it is interposed between the anti-pre-reset signal APR and the pre-reset signal PR, or intermediately of the anti-pre-reset signals APR or before the anti-pre-reset signal APR. Meanwhile, the anti-counter-assist signal AAA may be utilized as the entirety or a portion of the anti-pre-reset signal APR to shorten the time duration of the anti-pre-reset signal APR.

In the wave forms shown in this FIG. 24, it is preferred that the area intensity (effective value) of the wave form of the pre-reset signal PR is not less than the sum of the area intensities of the selection signal S and the aid-assist signal AS. The area intensity of the wave form of the anti-pre-reset signal APR is set to take the value which is not more than the remainder obtained by subtracting the area intensity of the wave form of the aid-assist signal AS from the area intensity of the wave form of the pre-reset signal PR.

The wave form of the pre-rest signal PR is added before the selection period. It may follow the selection signal S either successively or not. The wave form of the anti-aid-assist signal AAS is added before the selection period. For example, it may be interposed between the pre-reset signal PR and the selection signal S, intermediately of the application of pre-reset signals PR or before the pre-reset signal PR.

Meanwhile, it will be noted hereby that the drive margin index takes a larger value than that in the prior art 1/4 bias two-pulse driving method to make it possible to increase the scanning speed as high as two times, when the aid-assist signal AS and the counter-assist signal AA are additionally applied in the 1/2 bias two-pulse driving method as shown in FIG. 24, although detailed descriptions thereof will not be given hereby.

Figure 25:
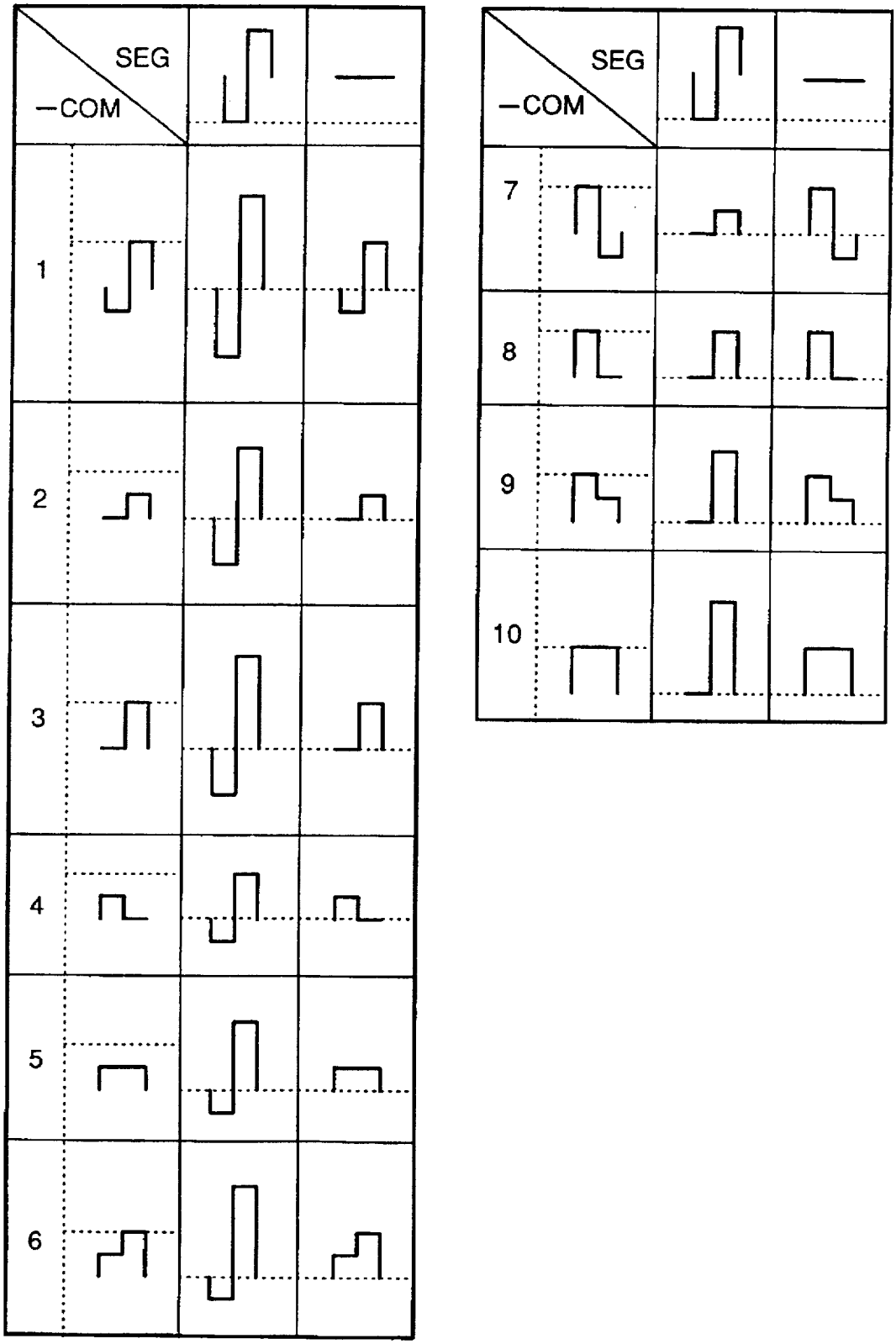
FIG. 25 shows the modified wave form examples of the aid-assist signals.

FIG. 25 shows modified examples of the aid-assist wave form which may be used in the present invention, and includes the scanning signal (-COM) 5 is the one which has been used in FIG. 17 and the scanning signal (-COM) 10 is the one which has been used in FIG. 22. Amongst them, preferable wave forms are the wave forms denoted by Nos. 4, 5, 6, 7, 8, 9 and 10, the most preferable being the wave forms denoted by Nos. 7, 8, 9 and 10.

The illustrated wave forms are examples in the 1/4 bias method, and they are reformed as the bias is varied. Since the illustrated wave forms are proposed in the premise that a multi-channel parallel analog switch is used, the electric voltages thereof have been limited to 4 to 5 level. However, without such a premise, further variations may be taken into account.

A method wherein an appropriate positive electric voltage is applied for a moment (for about 2τ) may be anticipated. The positive electric voltage applied therein is preferably set to a level lower than the electric voltage level at the selection step. The substance of this wave form is to establish the positive bias condition for a moment immediately after the selection step, and the wave form is not limited only to these illustrated variations.

It suffices that the anti-aid-assist signal AAS has a wave form for cancelling the direct current component of the corresponding aid-assist signal AS. In the simplest mode, a wave form inverse to the polarity of the aid-assist signal AS may be added. As to the width thereof, there arises no problem when it is set more than the illustrated width (2τ), and it may be set to 3τ, 4τ and so on.

Figure 26:
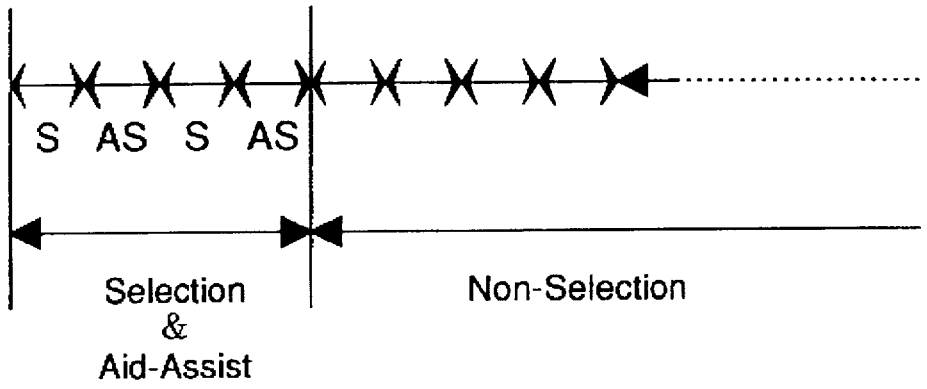
FIG. 26 is a chart showing the scanning signal sequence in a sixth embodiment of the invention in which a double-assist signal is applied.
Figure 27:
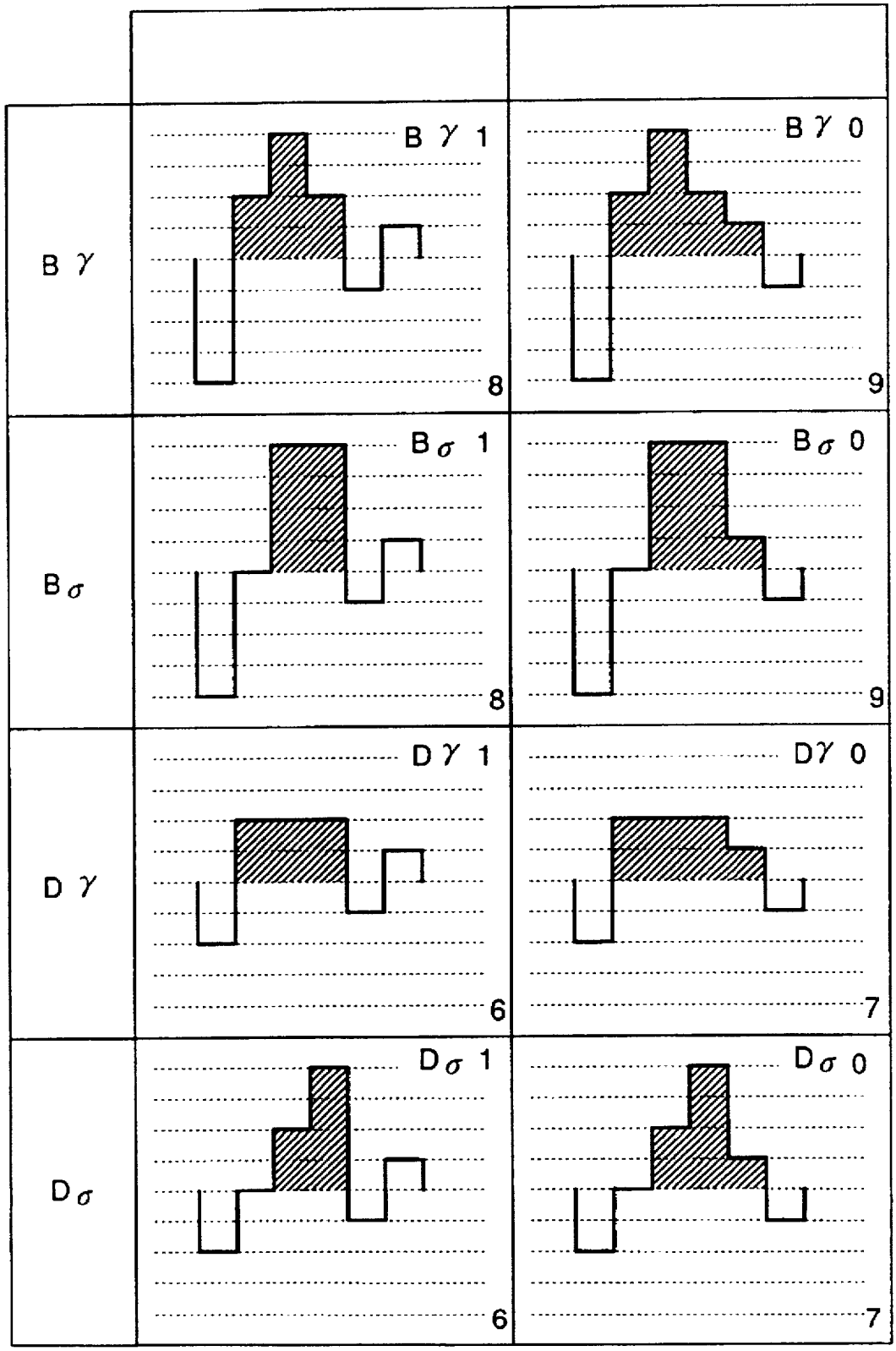
FIG. 27 is a diagram showing the difference in wave form of the drive signals which differ in response to the combinations of respective signals in the sixth embodiment.

FIG. 26 shows the scanning signal sequence in a sixth embodiment of the 1/4 bias two-pulse driving method, and FIG. 27 is a diagram showing the combinations of the signals. In this embodiment, an aid-assist signal AS having the time duration of 2τ is divided into two 1τ fractions, and respective fractions are interposed in-between and after the pulses of the selection signal S which is also divided into fractions for each 1τ durations (Double Assist Signal). As a result, the pulse areas in this embodiment occupy the hatched portions shown in FIG. 27, the area intensities (effective value) thereof being those represented by the numerals at the lower right positions of respective wave forms.

Figure 28:
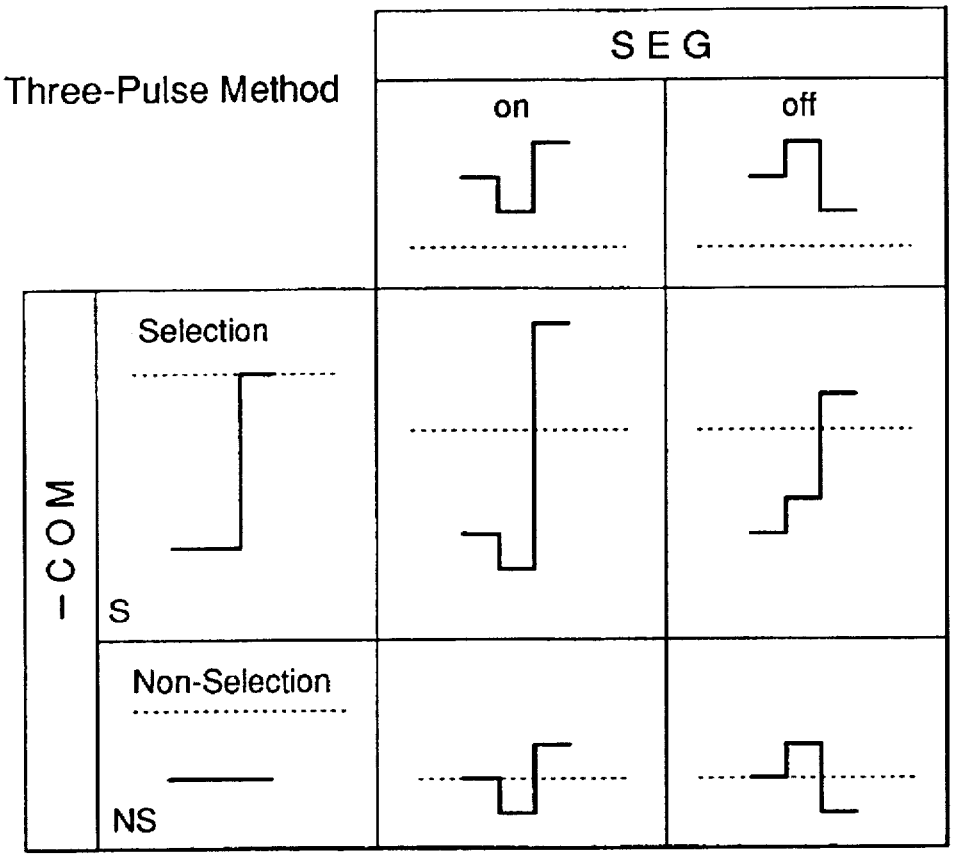
FIG. 28 PRIOR ART
FIG. 28 is an illustration showing the prior art three-pulse driving method.
Figure 28:
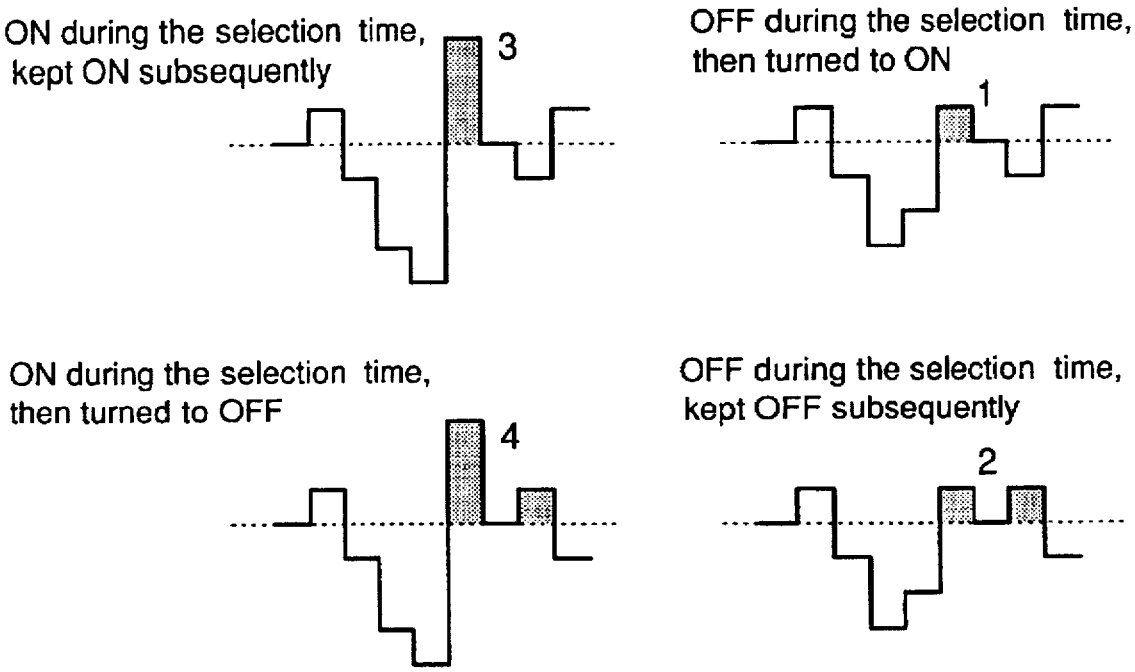
FIG. 28 PRIOR ART
Figure 29:
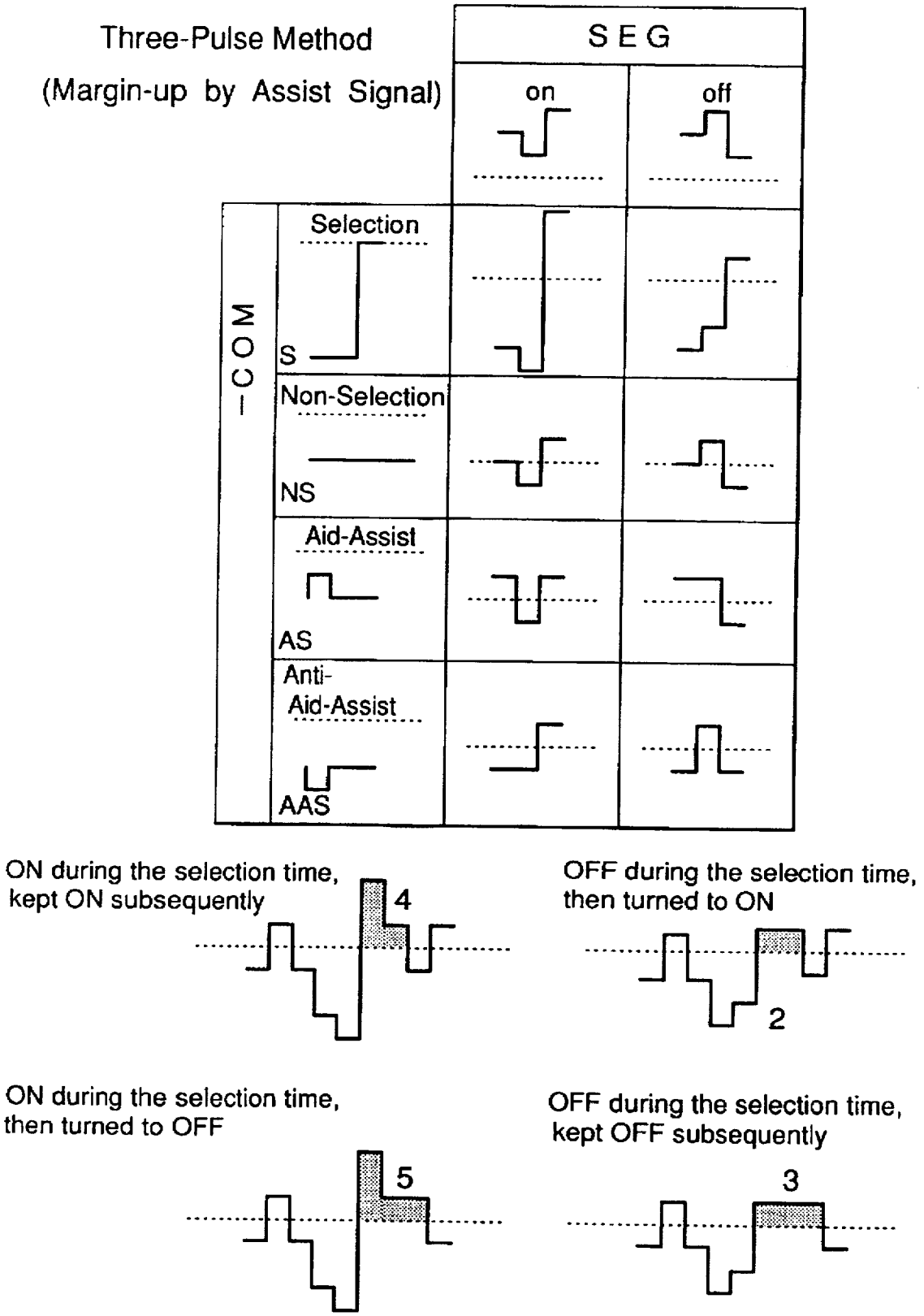
FIG. 29 is an illustration showing a seventh embodiment in which the invention is applied to the three-pulse driving method.

In a seventh embodiment the invention is applied to the 1/3 bias three-pulse driving method; and FIG. 28 is an illustration showing the wave forms in an exemplified prior art three-pulse driving method and FIG. 29 is an illustration showing the wave forms in the method to which the seventh embodiment is applied. In these three-pulse driving methods, the drive margin index, which is 3/2=1.5 in the prior art, is decreased to 4/3=1.33 by the application of the invention. However, by increasing 1/3 bias to 1/2 bias in such a case, it becomes possible to improve the image quality for a reason similar to that described in the preceding two-pulse driving method.

Figure 30:
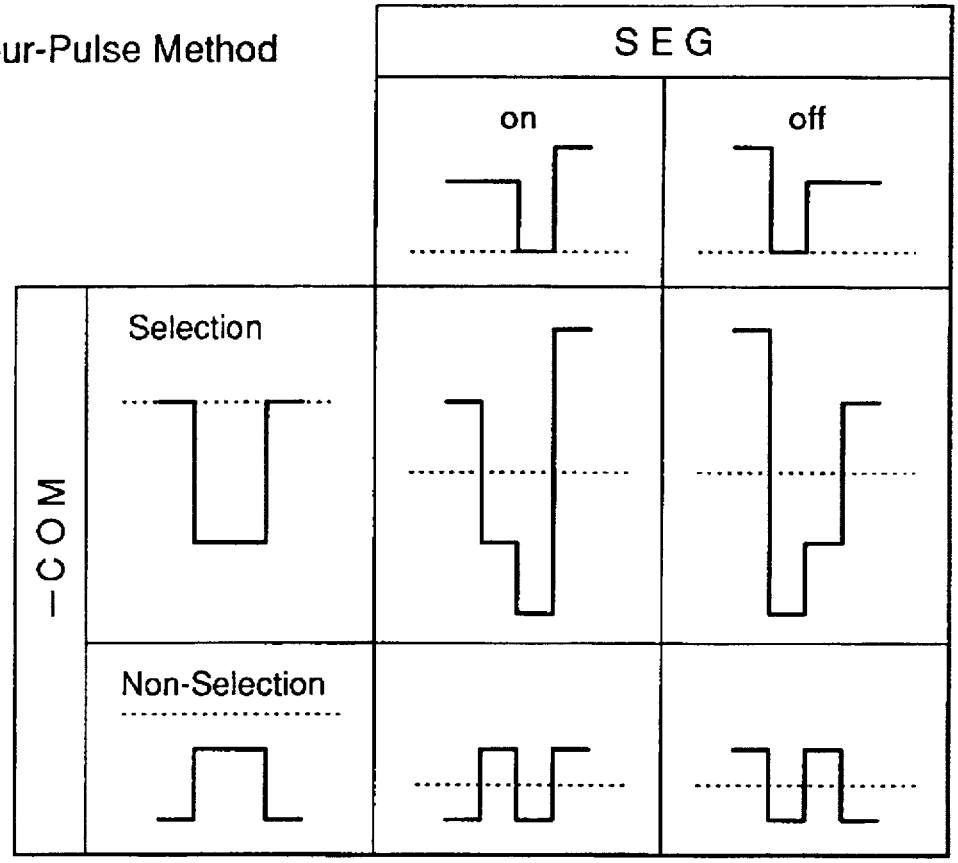
FIG. 30 PRIOR ART
FIG. 30 is an illustration showing the prior art four-pulse driving method.
Figure 30:
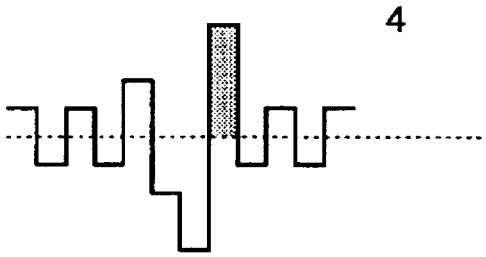
FIG. 30 PRIOR ART
Figure 30:
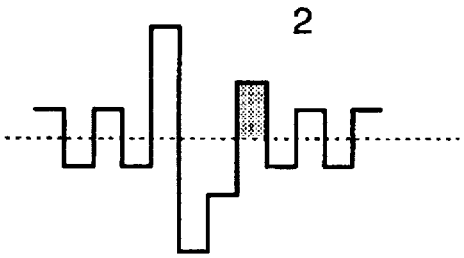
FIG. 30 PRIOR ART
Figure 30:
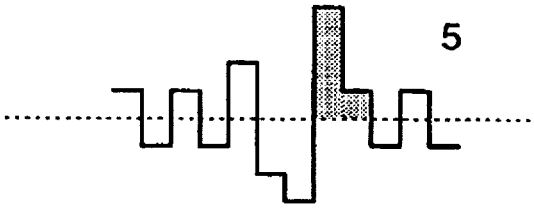
FIG. 30 PRIOR ART
Figure 30:
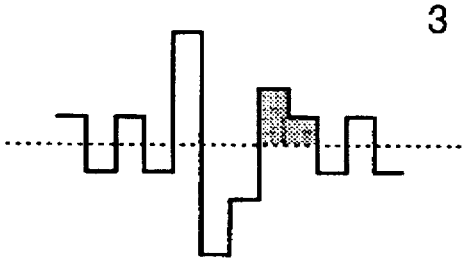
FIG. 30 PRIOR ART
Figure 31:
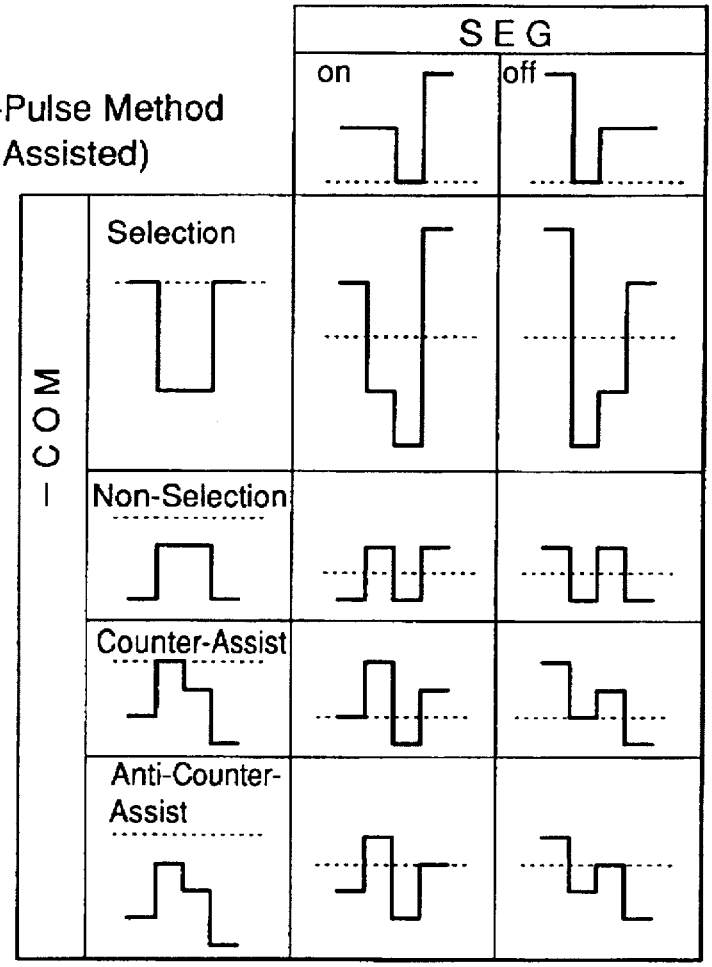
FIG. 31 is an illustration showing an eighth embodiment in which the invention is applied to the four-pulse driving method.
Figure 31:
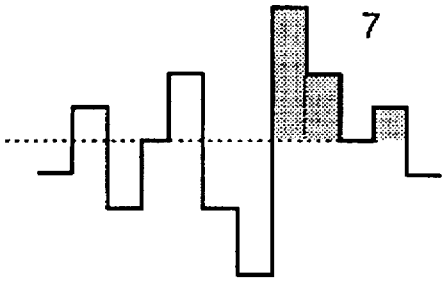
Figure 31:
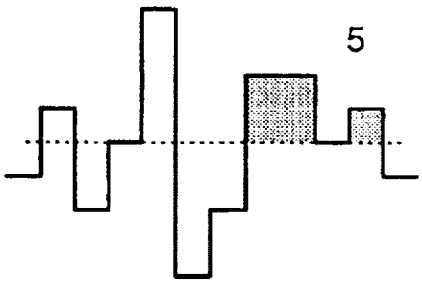
Figure 31:
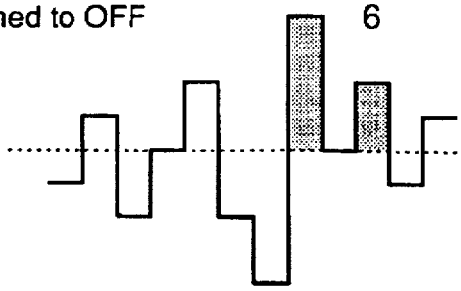
Figure 31:
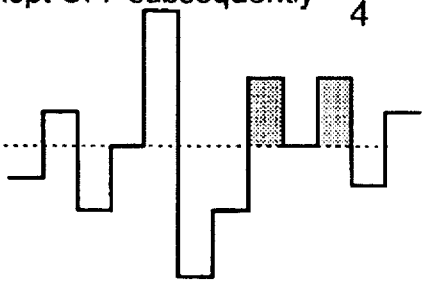

An eighth embodiment relates to a 1/4 bias four-pulse driving method; and FIG. 30 is an illustration showing the wave forms in the prior art method, whereas FIG. 31 is an illustration showing the wave forms in the method to which the eighth embodiment is applied. According to this four-pulse method, the drive margin index can be increased from 4/3=1.33, as in the prior art method, to 6/4=1.5.

Although a ferroelectric liquid crystal having a property of responding to the product (effective value, area intensity) of the electric voltage of pulse and the time has been used in the illustrated embodiments, the present invention is not limited only thereto but may be applied to other display devices, for example, dispersion type liquid crystals, SBIND, etc., as far as they are display devices having the bistability even if they are the liquid crystals which do not respond to the said product, and thus it is intended that the invention includes these alternatives.

As has been described hereinabove, the first one of the present invention resides in the addition of a counter-assist signal, which has a polarity inverse to the polarity of the effective pulse of the selection signal for inverting the reset state and is added immediately after the application of the effective pulse. By the addition thereof, decrease in drive margin by the non-selection signal, when the drive margin is decreased by the combination with the subsequent non-selection signal following the effective pulse, can be prevented to maintain the drive margin at a high level. The image quality can be improved, accordingly.

Meanwhile, it is desirous that the counter-assist signal have the same time duration as that of the selection signal. By adding an aid-assist signal having a polarity the same as that of the effective pulse of the selection signal before the counter-assist signal thereby to increase substantially the pulse area contributing for writing, the switching speed for every picture element can be increased without raising electric voltage of the drive signal. The aid-assist signal may also be added immediately before the effective pulse.

As has been described above, in the addition of an aid-assist signal having the same polarity as that of the effective pulse of the selection signal for inverts the reset state at least one portion of before or after the effective pulse. By the addition thereof, the pulse area of the effective pulse can be substantially increased. Thus, the switching speed of each picture element can be increased without raising the electric voltage of the scanning signal and the display signal. Accordingly, there is no need for improving the voltage-proof property of the driver circuit, and IC elements which sustain only a low electric voltage can be used. Since the switching speed is increased, the tendency of the occurrence of flickering can be suppressed to improve the image quality.

Meanwhile, the aid-assist signal may be interposed, other than the interposition thereof immediately after the effective pulse, immediately before the effective pulse, or may be divided into two fractions which are interposed before and after the effective pulse. The length of the aid-assist signal, namely the pulse width, may be the same as or more than that of the selection signal when the aid-assist signal is added either before or after the effective pulse, preferably ranging from one to four times as long as that of the effective pulse. On the other hand, when it is divided into fractions and the fractions are applied separately before and after the effective pulse, a desirable pulse width of each fraction ranges from not less than the pulse width of the selection signal, more preferably from 0.5 to 2 times the pulse width of the selection signal.

The electric voltages and pulse widths of these aid-assist signals must be determined in consideration of the pulse area needed for inverting the reset state and the pulse area needed for maintaining the reset state without inverting the same. They must be determined also in consideration of the alternating current frequency required for driving the picture elements, since the direct current components applied on every picture element are increased as the pulse width becomes wider.

Futhermore, it is effective for improving the image quality to increase the bias ratio in addition to the interposition of the aid-assist signal. For example, even when the drive margin index is lowered by the interposition of the aid-assist signal, the scanning speed can be increased and the contrast can be improved by increasing the bias ratio from 1/4 to 1/2 or so on.

I claim:

1. In a method for driving a matrix type flat panel display device wherein a row of scanning electrodes intersects a row of signal electrodes at an intersecting point, wherein a bistable picture element is arranged at said intersecting point, wherein a scanning signal is applied to said row of scanning electrodes and an ON or OFF display signal is applied to said row of signal electrodes, wherein a drive signal is synthesized by a combination of said scanning signal and said ON or OFF display signal at said intersecting point, and wherein said scanning signal comprises:

(1) a reset signal for resetting all said bistable picture elements along said row of scanning electrodes to one of a dark or bright state;

(2) a selection signal for setting a particular bistable picture element at a particular intersecting point on said row of scanning electrodes to one of the bright or dark states from a reset state which has been reset by said reset signal;

(3) a non-selection signal following the selection signal, said non-selection signal keeping the state of said particular bistable picture element set by said selection signal, (4) where a first part of said drive signal synthesized by a combination of said non-selection signal and said ON or OFF display signal has alternating positive and negative polarity pulses;

the improvement comprising the step of providing said scanning signal with an additional counter-assist signal which is applied immediately after said selection signal and before said non-selection signal;

said counter-assist signal having a waveform such that a second part of said drive signal synthesized by a combination of said counter-assist signal and said ON or OFF display signal has a polarity inverse to a polarity of an effective pulse, said effective pulse being a third part of said drive signal synthesized by a combination of said selection signal and said ON or OFF display signal and which contributes to setting the particular bistable picture element to one of the bright or dark states; and a first time period of said counter-assist signal overlapping a second time period of a respective next selection signal for a respective next row of scanning electrodes.

2. The method of claim 1, wherein said counter-assist signal has a time period equal to that of said selection signal.

3. The method of claim 2, wherein an aid-assist signal is additionally applied immediately before the application of said selection signal, said aid-assist signal having a waveform such that a sixth part of said drive signal synthesized by a combination of said aid-assist signal and said ON or OFF display signal has a polarity same as the polarity of said effective pulse.

4. The method of claim 2, wherein an aid-assist signal is additionally applied between the application of said selection signal and the application of said counter-assist signal, said aid-assist signal having a waveform such that a seventh part of said drive signal synthesized by a combination of said aid-assist signal and said ON or OFF display signal has a polarity same as the polarity of said effective pulse.

5. The method of claim 1, wherein an aid-assist signal is additionally applied immediately before the application of of said selection signal, said aid-assist signal having a waveform such that a fourth part of said drive signal synthesized by a combination of said aid-assist signal and said ON or OFF display signal has a polarity same as the polarity of said effective pulse.

6. The method of claim 1, wherein an aid-assist signal is additionally applied between the application of said selection signal and the application of said counter-assist signal, said aid-assist signal having a waveform such that a fifth part of said drive signal synthesized by a combination of said aid-assist signal and said ON or OFF display signal has a polarity same as the polarity of said effective pulse.

7. In a method for driving a matrix type flat panel display device wherein a row of scanning electrodes intersects a row of signal electrodes at an intersecting point, wherein a bistable picture element is arranged at said intersecting point, wherein a scanning signal is applied to said row of scanning electrodes and an ON or OFF display signal is applied to said row of signal electrodes, wherein a drive signal is synthesized by a combination of said scanning signal and said ON or OFF display signal at said intersecting point, and wherein said scanning signal comprises:

(1) a reset signal for resetting all said bistable picture elements along said row of scanning electrodes to one of a dark or bright state;

(2) a selection signal for setting a particular bistable picture element at a particular intersecting point on said row of scanning electrodes to one of the bright or dark states from a reset state which has been reset by said reset signal;

(3) a non-selection signal following the selection signal, said non-selection signal keeping the state of said particular bistable picture element set by said selection signal, (4) where a first part of said drive signal synthesized by a combination of said non-selection signal and said ON or OFF display signal has alternating positive and negative polarity pulses;

the improvement comprising the step of providing said scanning signal with an additional aid-assist signal which is applied at least one time immediately before or immediately after the application of said selection signal;

said aid-assist signal having a waveform such that a second part of said drive signal synthesized by a combination of said aid-assist signal and said ON or OFF display signal has a polarity same as a polarity of an effective pulse, said effective pulse being a third part of said drive signal synthesized by a combination of said selection signal and said ON or OFF display signal and which contributes to setting the particular bistable picture element to one of the bright or dark states; and a first time period of said aid-assist signal overlapping a second time period of a respective adjacent selection signal for a respective adjacent row of scanning electrodes.

8. The method of claim 7, wherein a bias ratio, which is an absolute value of a ratio of a voltage of said first part of said drive signal synthesized by the combination of said non-selection signal and said ON or OFF display signal to a voltage of said third part of said drive signal synthesized by the combination of said selection signal and said ON or OFF display signal, is greater than 1/4.

9. In a method for driving a matrix type flat panel display device wherein a row of scanning electrodes intersects a row of signal electrodes at an intersecting point, wherein a bistable picture element is arranged at said intersecting point, wherein a scanning signal is applied to said row of scanning electrodes and an ON or OFF display signal is applied to said row of signal electrodes, wherein a drive signal is synthesized by a combination of said scanning signal and said ON or OFF display signal at said intersecting point, and wherein said scanning signal comprises:

(1) a reset signal for resetting all said bistable picture elements along said row of scanning electrodes to one of a dark or bright state;

(2) a selection signal for setting a particular bistable picture element at a particular intersecting point on said row of scanning electrodes to one of the bright or dark states from a reset state which has been reset by said reset signal;

(3) a non-selection signal following the selection signal, said non-selection signal keeping the state of said particular bistable picture element set by said selection signal, (4) where a first part of said drive signal synthesized by a combination of said non-selection signal and said ON or OFF display signal has alternating positive and negative polarity pulses;

the improvement comprising the step of providing said scanning signal with an additional aid-assist signal which is applied immediately after the application of said selection signal;

said aid-assist signal having a waveform such that a second part of said drive signal synthesized by a combination of said aid-assist signal and said ON or OFF display signal has a polarity same as a polarity of an effective pulse, said effective pulse being a third part of said drive signal synthesized by a combination of said selection signal and said ON or OFF display signal and which contributes to setting the particular bistable picture element to one of the bright or dark states; and a first time period of said aid-assist signal overlapping a second time period of a respective next selection signal for a respective next row of scanning electrodes.

10. In a method for driving a matrix type flat panel display device wherein a row of scanning electrodes intersects a row of signal electrodes at an intersecting point, wherein a bistable picture element is arranged at said intersecting point, wherein a scanning signal is applied to said row of scanning electrodes and an ON or OFF display signal is applied to said row of signal electrodes, wherein a drive signal is synthesized by a combination of said scanning signal and said ON or OFF display signal at said intersecting point, and wherein said scanning signal comprises:

(1) a reset signal for resetting all said bistable picture elements along said row of scanning electrodes to one of a dark or bright state;

(2) a selection signal for setting a particular bistable picture element at a particular intersecting point on said row of scanning electrodes to one of the bright or dark states from a reset state which has been reset by said reset signal;

(3) a non-selection signal following the selection signal, said non-selection signal keeping the state of said particular bistable picture element set by said selection signal, (4) where a first part of said drive signal synthesized by a combination of said non-selection signal and said ON or OFF display signal has alternating positive and negative polarity pulses;

the improvement comprising the step of providing said scanning signal with an additional aid-assist signal which is applied immediately before the application of said selection signal;

said aid-assist signal having a waveform such that a second part of said drive signal synthesized by a combination of said aid-assist signal and said ON or OFF display signal has a polarity same as a polarity of an effective pulse, said effective pulse being a third part of said drive signal synthesized by a combination of said selection signal and said ON or OFF display signal and which contributes to setting the particular bistable picture element to one of the bright or dark states; and a first time period of said aid-assist signal overlapping a second time period of a respective preceding selection signal for a respective preceding row of scanning electrodes.

11. In a method for driving a matrix type flat panel display device wherein a row of scanning electrodes intersects a row of signal electrodes at an intersecting point, wherein a bistable picture element is arranged at said intersecting point, wherein a scanning signal is applied to said row of scanning electrodes and an ON or OFF display signal is applied to said row of signal electrodes, wherein a drive signal is synthesized by a combination of said scanning signal and said ON or OFF display signal at said intersecting point, and wherein said scanning signal comprises:

(1) a reset signal for resetting all said bistable picture elements along said row of scanning electrodes to one of a dark or bright state;

(2) a selection signal for setting a particular bistable picture element at a particular intersecting point on said row of scanning electrodes to one of the bright or dark states from a reset state which has been reset by said reset signal;

(3) a non-selection signal following the selection signal, said non-selection signal keeping the state of said particular bistable picture element set by said selection signal, (4) where a first part of said drive signal synthesized by a combination of said non-selection signal and said ON or OFF display signal has alternating positive and negative polarity pulses;

the improvement comprising the step of providing said scanning signal with an additional aid-assist signal which is applied immediately before and immediately after the application of said selection signal;

said aid-assist signal having a waveform such that a second part of said drive signal synthesized by a combination of said aid-assist signal and said ON or OFF display signal has a polarity same as a polarity of an effective pulse, said effective pulse being a third part of said drive signal synthesized by a combination of said selection signal and said ON or OFF display signal and which contributes to setting the particular bistable picture element to one of the bright or dark states; and a first time period of said aid-assist signal applied immediately before the application of the selection signal overlapping with a second time period of a respective preceding selection signal for a respective preceding row of scanning electrodes, and a third time period of said aid-assist signal applied immediately after the application of the selection signal overlapping with a fourth time period of a respective next selection signal for a respective next row of scanning electrodes.

12. In a method for driving a matrix type flat panel display device wherein a row of scanning electrodes intersects a row of signal electrodes at an intersecting point, wherein a bistable picture element is arranged at said intersecting point, wherein a scanning signal is applied to said row of scanning electrodes and an ON or OFF display signal is applied to said row of signal electrodes, wherein a drive signal is synthesized by a combination of said scanning signal and said ON or OFF display signal at said intersecting point, and wherein said scanning signal comprises:

(1) a reset signal for resetting all said bistable picture elements along said row of scanning electrodes to one of a dark or bright state;

(2) a selection signal for setting a particular bistable picture element at a particular intersecting point on said row of scanning electrodes to one of the bright or dark states from a reset state which has been reset by said reset signal;

(3) a non-selection signal following the selection signal, said non-selection signal keeping the state of said particular bistable picture element set by said selection signal, (4) where a first part of said drive signal synthesized by a combination of said non-selection signal and said ON or OFF display signal has alternating positive and negative polarity pulses;

the improvement comprising the step of providing said scanning signal with an additional signal which is applied immediately adjacent to the application of said selection signal, a first time period of said additional signal overlapping a second time period of a respective adjacent selection signal for a respective adjacent row of scanning electrodes.

13. A method for driving a matrix type flat panel display device, comprising the steps of:

intersecting a row of scanning electrodes with a row of signal electrodes at an intersecting point in the vicinity of a bistable picture element;

applying a scanning signal to said row of scanning electrodes and an ON or OFF display signal to said row of signal electrodes, said scanning signal comprising:

(1) a reset signal for resetting all said bistable picture elements along said row of scanning electrodes to one of a dark or bright state;

(2) a selection signal for setting a particular bistable picture element at a particular intersecting point on said row of scanning electrodes to one of the bright or dark states from a reset state which has been reset by said reset signal;

(3) a non-selection signal following the selection signal, said non-selection signal keeping the state of said particular bistable picture element set by said selection signal; and (4) an additional signal which is applied immediately adjacent to the application of said selection signal so that part of said additional signal overlaps with part of a respective adjacent selection signal for a respective adjacent row of scanning electrodes; and synthesizing a drive signal by combining said scanning signal and said ON or OFF display signal at said intersecting point so that part of said drive signal is synthesized by a combination of said non-selection signal and said ON or OFF display signal, said part having alternating positive and negative polarity pulses.

14. A method for driving a matrix type flat panel display device according to claim 13, wherein said additional signal comprises at least one of a counter-assist signal and an aid-assist signal.

* * * * *